US009882314B2

(12) United States Patent
Casher et al.

(10) Patent No.: US 9,882,314 B2
(45) **Date of Patent: *Jan. 30, 2018**

(54) DIFFERENTIALLY COUPLED CONNECTOR

(71) Applicant: Molex, LLC, Lisle, IL (US)

(72) Inventors: Patrick R. Casher, North Aurora, IL (US); Jerry Kachlic, Glen Ellyn, IL (US); Michael Rowlands, Naperville, IL (US); Kent E. Regnier, Lombard, IL (US)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/341,346

(22) Filed: Nov. 2, 2016

(65) Prior Publication Data

US 2017/0047688 A1 Feb. 16, 2017

Related U.S. Application Data

(63) Continuation of application No. 14/728,632, filed on Jun. 2, 2015, now Pat. No. 9,515,421, which is a (Continued)

(51) Int. Cl.

| | |
|---|---|
| ***H01R 24/00*** | (2011.01) |
| ***H01R 13/6471*** | (2011.01) |
| ***H01R 13/658*** | (2011.01) |
| ***H01R 13/26*** | (2006.01) |
| ***H01R 13/6461*** | (2011.01) |

(Continued)

(52) U.S. Cl.

CPC ..... *H01R 13/6471* (2013.01); *H01R 12/724* (2013.01); *H01R 13/26* (2013.01); *H01R 13/6461* (2013.01); *H01R 13/658* (2013.01); *H01R 23/7073* (2013.01); *H01R 24/64* (2013.01); *H01R 24/76* (2013.01); *H01R 12/721* (2013.01); *H01R 23/02* (2013.01); *H01R 23/725* (2013.01); *H01R 2107/00* (2013.01)

(58) Field of Classification Search

CPC .. H01R 23/7073; H01R 23/02; H01R 23/725; H01R 13/26; H01R 13/658

USPC ..... 439/676, 660, 74, 79, 607.01

See application file for complete search history.

(56) References Cited

U.S. PATENT DOCUMENTS 5,342,220 A * 8/1994 Kodama ..... H01R 13/6485 439/108

6,478,624 B2 11/2002 Ramey et al.

(Continued)

FOREIGN PATENT DOCUMENTS

JP 2007-115707 A 5/2007

JP 2009-117128 A 5/2009

(Continued)

*Primary Examiner* — Abdullah Riyami

*Assistant Examiner* — Vladimir Imas

(74) *Attorney, Agent, or Firm* — Jeffrey K. Jacobs

(57) ABSTRACT

A connector is provided with a pair of terminals configured to provide a differential signal pair. A ground terminal is positioned on opposing sides of the differential pair. The body of the differential pair is configured so as to bring the differential pair closer together. In an embodiment, the % coupling on the differential pair is increase at least 5% more than a design where the four terminals are positioned at a constant pitch between the tail and the contact.

10 Claims, 22 Drawing Sheets

Related U.S. Application Data continuation of application No. 13/578,839, filed as application No. PCT/US2011/024880 on Feb. 15, 2011, now Pat. No. 9,083,130.

(60) Provisional application No. 61/304,708, filed on Feb. 15, 2010.

(51) Int. Cl.

| | |
|---|---|
| ***H01R 24/64*** | (2011.01) |
| ***H01R 24/76*** | (2011.01) |
| *H01R 12/50* | (2011.01) |
| *H01R 12/72* | (2011.01) |
| *H01R 107/00* | (2006.01) |

(56) References Cited

U.S. PATENT DOCUMENTS 6,565,383 B1 * 5/2003 Wu ..... H01R 12/7023 439/358
6,663,428 B1 * 12/2003 Wu ..... H01R 23/688 439/108
6,827,611 B1 12/2004 Payne et al.
6,916,209 B1 * 7/2005 Casher ..... H01R 13/6467 439/676
6,969,268 B2 * 11/2005 Brunker ..... H01R 23/688 439/108
7,070,424 B2 7/2006 Obikane et al.
7,160,141 B2 * 1/2007 Marshall ..... H01R 12/716 439/451
7,166,000 B2 * 1/2007 Pharney ..... H01R 13/6658 439/676
7,270,570 B1 9/2007 Hamner et al.
7,549,882 B2 6/2009 Kimura
7,578,705 B2 * 8/2009 He ..... H01R 13/514 439/660
7,591,683 B2 9/2009 Zhang et al.
7,591,684 B2 * 9/2009 Zhang ..... H01R 12/716 439/108
7,670,199 B2 3/2010 Nagata et al.
7,674,118 B2 3/2010 He
7,699,663 B1 * 4/2010 Little ..... H01R 13/65802 439/660
7,794,240 B2 * 9/2010 Cohen ..... H01R 12/727 439/78
7,794,284 B1 * 9/2010 He ..... G02B 6/3817 439/660
7,976,344 B2 * 7/2011 Brunker ..... H01R 13/504 439/631
8,029,319 B2 * 10/2011 Kameyama ..... H01R 12/712 439/607.01
8,038,480 B2 * 10/2011 Wei ..... H01R 13/502 439/607.01
8,157,599 B2 * 4/2012 Wei ..... H01R 13/502 439/607.01
8,226,441 B2 * 7/2012 Regnier ..... H01R 9/038 439/626
8,251,746 B2 * 8/2012 Zhang ..... H01R 12/724 439/607.11
8,323,057 B2 * 12/2012 Ho ..... H01R 12/725 439/607.4
8,371,882 B1 * 2/2013 Szczesny ..... H01R 24/64 439/660
8,382,519 B2 * 2/2013 Lin ..... H01R 13/6485 439/607.01
8,419,474 B2 * 4/2013 Zhang ..... G02B 6/3817 439/607.25
8,535,086 B2 * 9/2013 Hunkins ..... H01R 12/7082 439/485
8,574,011 B2 * 11/2013 Shih ..... H01R 27/00 439/660
8,657,631 B2 * 2/2014 Lang ..... H01R 13/65802 439/607.08
8,702,452 B2 * 4/2014 Tai ..... H01R 13/6461 439/108
2002/0048995 A1 4/2002 Shindo
2002/0102885 A1 8/2002 Kline
2003/0064626 A1 * 4/2003 Kemmick ..... H01R 23/688 439/607.05
2005/0164561 A1 * 7/2005 Casher ..... H01R 13/6467 439/676
2006/0014438 A1 1/2006 Regnier
2006/0189212 A1 8/2006 Avery et al.
2008/0009147 A1 1/2008 Avery et al.
2008/0261448 A1 * 10/2008 Yi ..... H01R 31/005 439/607.01
2008/0311801 A1 * 12/2008 Chen ..... H01R 23/6873 439/733.1
2009/0042450 A1 * 2/2009 Zheng ..... H01R 23/6873 439/660
2009/0042451 A1 * 2/2009 He ..... H01R 13/514 439/660
2009/0149045 A1 * 6/2009 Chen ..... H01R 13/6471 439/92
2010/0267262 A1 * 10/2010 Lin ..... H01R 27/00 439/218
2011/0269346 A1 * 11/2011 Casher ..... H01R 29/00 439/626
2011/0300757 A1 * 12/2011 Regnier ..... H01R 29/00 439/626
2012/0034820 A1 2/2012 Lang et al.

FOREIGN PATENT DOCUMENTS

TW 422461 2/2001
TW 461621 U 10/2001
TW M366779 U 10/2009
WO WO 03/026078 A1 3/2003

* cited by examiner

DIFFERENTIALLY COUPLED CONNECTOR

RELATED APPLICATIONS

This application is a continuation of U.S. application Ser. No. 14/728,632, filed Jun. 2, 2015, now U.S. Pat. No. 9,515,421, which is a continuation of U.S. application Ser. No. 13/578,839, filed Oct. 23, 2012, now U.S. Pat. No. 9,083,130, both of which is incorporated herein by reference in its entirety and which is a national phase of PCT application No. PCT/US2011/024880, filed Feb. 15, 2011, which in turn claims priority of U.S. Provisional Application No. 61/304,708, filed Feb. 15, 2010, which is incorporated herein by reference in its entirety.

BACKGROUND OF THE INVENTION

Field of the Invention

The present invention relates to the field of connectors, more specifically to connectors suitable for use in high data rate applications.

Description of Related Art

One known connector configuration is commonly referred to as a small form-factor pluggable (SFP) connector. SFP style connectors can be configured to provide two high data rate channels and a number of lower data rate channels. As can be appreciated, this configuration is sometimes referred to as a 1× connector as it provides for one channel of data communication for transmitting and one channel for receiving. Other connectors with similar form factors can provide more high data rate channels such as 4× connectors that provide four transmit and four receive channels. Because of the relatively small size, SFP-style connectors have proven useful for mounting in racks and other applications were space is at a premium and because of its performance, have also proven useful in relatively high performance applications. With ever increasing demands for more and more data, however, existing designs, even if potentially suitable for 10 Gbps data rates or greater, have begun to be less attractive for use in applications where it is generally desirable that the connector be somewhat future proof. Therefore, certain individuals would appreciate a SFP style connector that is suitable for applications where a higher data rates might be desired.

BRIEF SUMMARY OF THE INVENTION

A connector is provided that includes a housing. The housing includes a mating face with a slot that has a width and a first and second side. The slot can include a plurality of terminals on the first and second side of the slot, the terminals respectively positioned in a first and second row. At least two pairs of terminals in the first row are configured to provide a differentially coupled signal pair. A ground terminal is positioned on each side of each signal pair. A terminal block can be supported by the housing and can support the first row of terminals in the housing and the terminal block can extend the length of the slot. The signal pairs can be configured to provide data rates of 16 Gbps or 20 Gbps or even 25 Gbps.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1A:
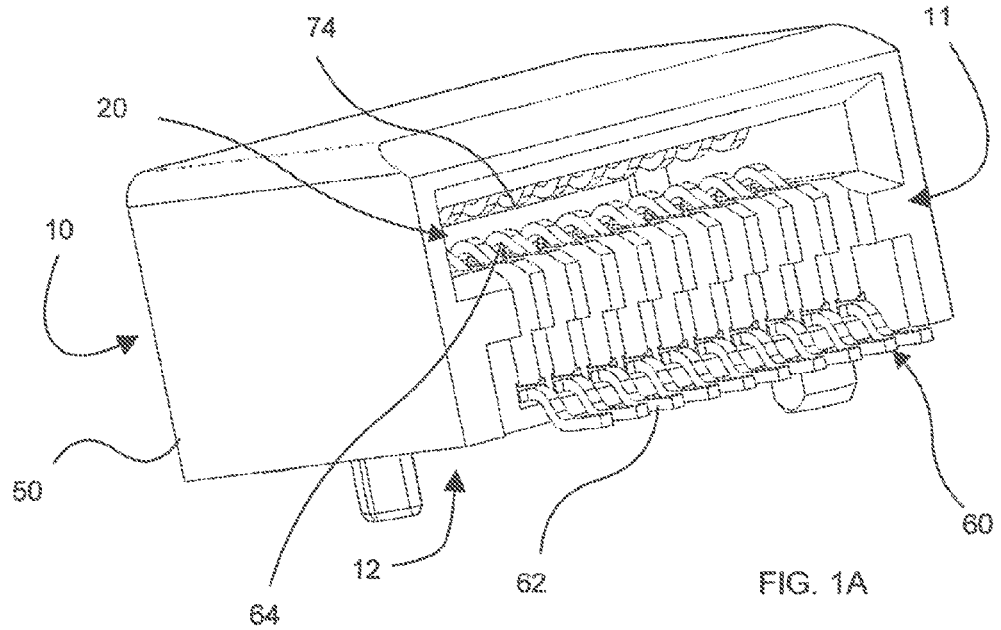
FIG. 1A illustrates a perspective view of an embodiment of a connector with a slot.
Figure 1B:
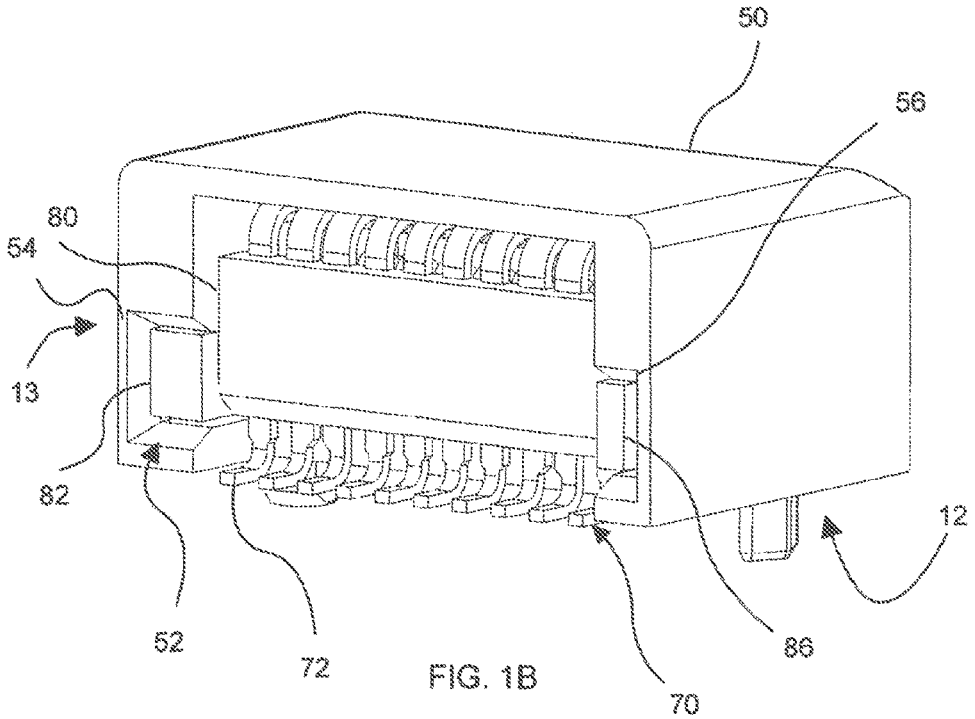
FIG. 1B illustrates another perspective view of the connector depicted in FIG. 1A.
Figure 1C:
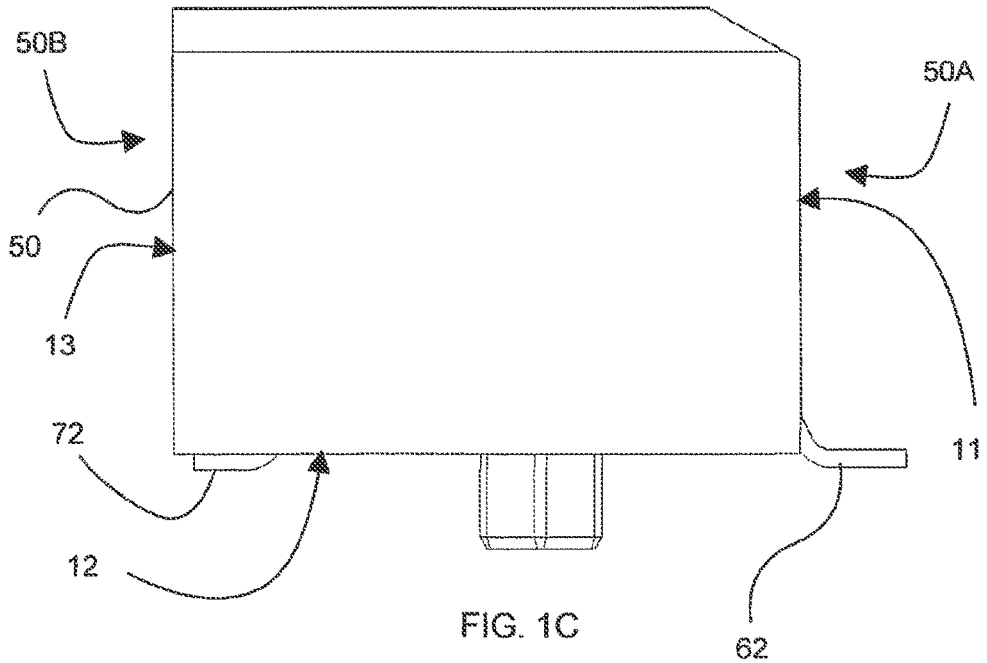
FIG. 1C illustrates an elevated side view of the connector depicted in FIG. 1A.
Figure 1D:
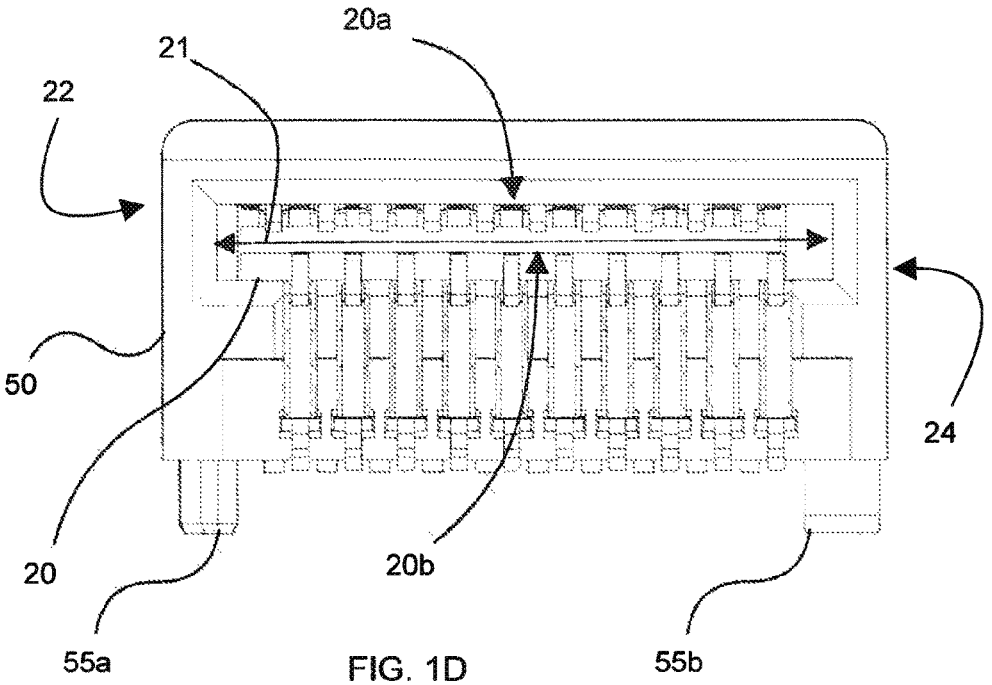
FIG. 1D illustrates an elevated front view of the connector depicted in FIG. 1A.
Figure 2:
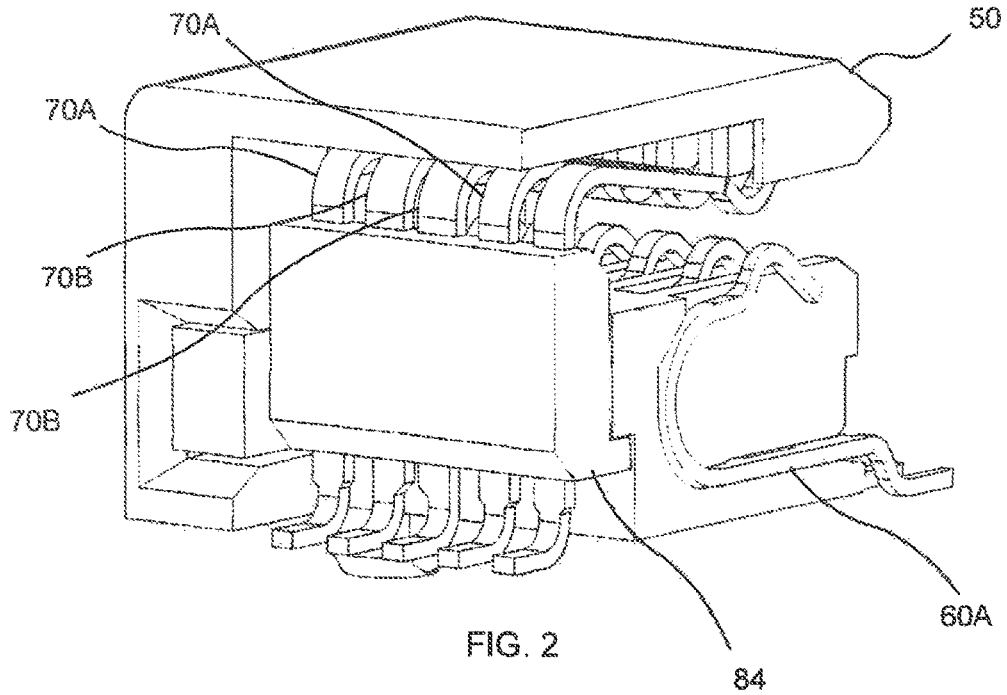
FIG. 2 illustrates a perspective view of a cross-section of the connector depicted in FIG. 1A.
Figure 3:
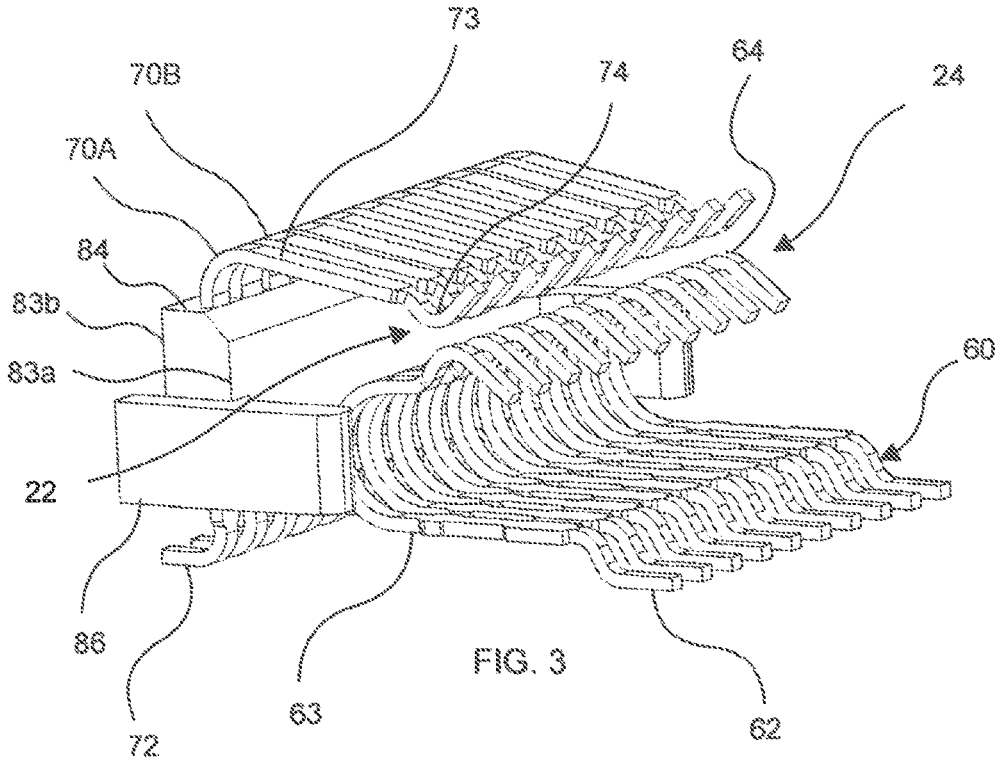
FIG. 3 illustrates a partial perspective view of the connector depicted in FIG. 1A.
Figure 4:
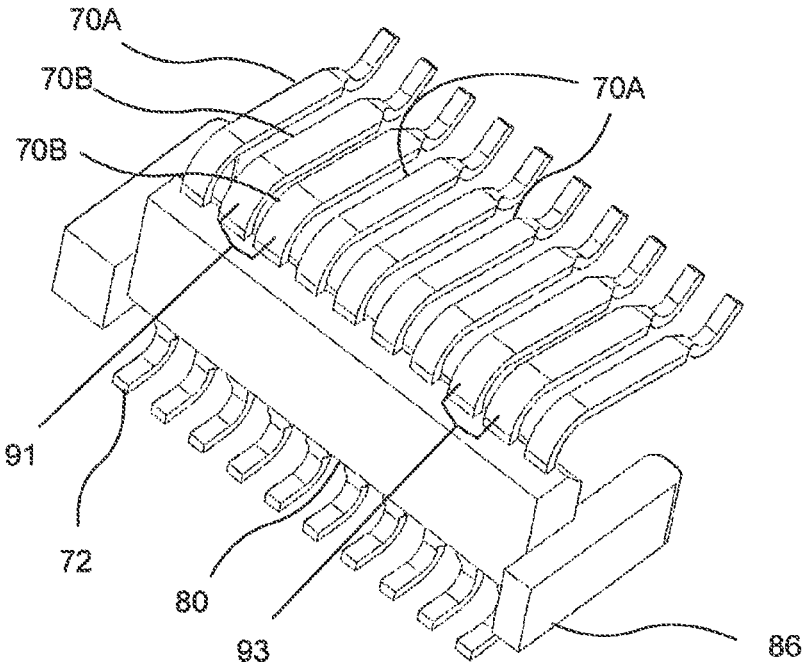
FIG. 4 illustrates a perspective view of an embodiment of a set of terminals supported by a terminal block.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Connectors commonly use one or more sets of terminal supported by a housing. Depending on the application, the housing may be mounted on a circuit board by itself (e.g., for internal applications) and when there is a desire to control EMI interfering with and being emitted from the connector it can be surrounded by a cage (e.g., for external applications). The disclosure provided herein is directed toward a connector that in certain embodiment is suitable for both internal and external applications and could be used with any appropriate cage design.

FIGS. 1A-6 illustrate views and features of an embodiment of a connector suitable to be mounted on a circuit board and to provide what is often referred to as 1× channel (e.g., one transmit and one receive channel). The connector includes a support face 10 and a mating face 11 and further includes a mounting side 12 on a housing 50 that has a front side 50A and a rear side 50B. The mounting side 12 is typically configured to be mounted on a support circuit board. The mating face 11 includes a slot 20 with a first side 20*a* and a second side 20*b* and a first set of terminals 70 and a second set of terminals 60 are positioned in the slot so as to provide a row 21 of contacts. The support face 10 includes a channel 52 that supports a terminal block 80. Each terminal in the first and second set includes a tail 72, 62, a body 73, 63 and a contact 74, 64.

To support and position the first set of terminals 70, the terminal block 80 can be inserted into the channel 52. As depicted, the terminal block in inserted from the rear side 50B toward the front side 50A, preferably in a manner parallel to a supporting circuit board. Unlike conventional waferized terminals (such as typically would be used for a stacked connector), however, the depicted embodiment allows the terminal block to be inserted into the housing in a first direction while provide a row 21 of contacts with the row of contacts being perpendicular to the insertion direction. In an embodiment, arms 82, 86 are mounted in notches 54, 56 in the channel 52 and the notches 54, 56 and the arms 82, 86 can be polarized so that the terminal block can only be inserted in a desired orientation.

As can be appreciated, signal terminals 70B are positioned so as to provide a signal pair 91 and 93 and both signal pairs are surrounded on both sides by ground terminals 70A. As can be further appreciated, a distance 102A (which is between terminals that form a signal pair) is less than a distance 103A. Similarly, as can be appreciated from FIG. 5, distance 102B is less than distance 103B. Thus, away from the tail and contact portions of the terminals, which as depicted are at a constant pitch and spacing, the spacing between the signal terminals that form the signal pair varies so as to provide the desired amount of preferential coupling. Due to the change in dielectric constants, it has been determined that it is beneficial to change the width of the terminals 70B from width 101A in the free portion to width 101B in the block portion (assuming that the thickness is not substantially changed). Thus, the interfaces 110 provide relatively constant tails and contacts widths and spacing to make mating of the connector straightforward while the signal pair spacing is adjusted to provide the desirable electrical performance.

As can be appreciated, the terminals supported by the terminal block are at a first pitch at the contact and have a second pitch in the body section. As can be further appreciated, the terminals body has a free portion and a block portion, the block portion residing in the terminal block. To account for the change in dielectric constant caused by the use of the terminal block, the terminals can have one pitch between the free body and another pitch in the terminal block portion. In any event, as can be appreciated from FIG. 5, the distance between terminals that form the signal pair can increase in the block portion compare to the distance between the same terminals in the free portion.

At the contact location it is difficult to vary the pitch due the desire to have a consistent and reliable connector with a series of contact pads on a mating card. It has been determined, however, that reducing the pitch between the differential pairs in the body section can provide a beneficial decrease cross talk. For example, in a connector with a 0.5 dB dip in insertion loss at about 8 GHz, by using preferential differential coupling it is possible to decrease the insertion loss to about 0.1 dB dip and to move the frequency of this dip loss out to frequencies greater than 11 GHz. Another measurement of the improvement can be determined by the crosstalk, which has a corresponding rise at the frequency of the insertion loss dip. An existing connector was tested and had crosstalk of about 20 dB at about 5 GHz. When the connector was configured in a manner similar to what is depicted in FIGS. 1A-7, the crosstalk was reduced to about 45 dB, a 25 dB reduction.

In a typical first ground terminal 70A, first signal terminal 70B, second signal terminal 70B, second ground terminal 70A arrangement, the spacing between the grounds and signals terminals is kept constant. This is particularly true for stitch SMT style connectors, such as known SFP or QSFP connectors as it is difficult (and perhaps impossible) to vary the distance between stitched terminals if the contacts are going to be kept at a constant pitch. Thus, the distance might be 0.47 mm between each adjacent terminal (which could be 0.33 mm wide so as to provide a desired 0.8 mm pitch). This leads to situation where 33% of the energy is carried via signal pair coupling and 66% of the energy is carried via the signal-to-ground structure.

It has been determined that the energy carried via the multi-terminal ground structure can create resonances that cause dips in insertion loss (and corresponding increases in crosstalk,) such as noted above. Therefore, it can be beneficial to increase the % coupling on a differential pair 91, 93. It should be noted that while two differential pair are illustrated in FIGS. 1A-7, these features can also be used on connectors with more than two differential pair.

It has been determined that one beneficial way to increase the % coupling on the signal terminals is to change the distance between the terminals. The use of blanked terminals supported by a terminal block as illustrated helps allow the distance to be varied. Because of interactions between the terminals, assuming that the ground and signal terminals have a uniform cross-section and associated housing portions, it has been determined that for x (in mm) equal to the distance between the differential pair and y (in mm) equal to the distance between a differential terminal and a ground terminal, the following simple relationship of $(1/x)/[(1/y)+(1/x)+(1/y)]$ provides the percent of energy carried via differential coupling for most symmetric terminal systems. In an embodiment where the distance between each body is 0.47 mm, for example, the formula for the % coupling via the signal pair is $1/0.47/[(1/0.47)+(1/0.47)+(1/0.47)]$ and this equals 0.33 or 33% coupling. By decreasing the distance between the terminals that make up the differential pair (and or increasing the distance between the signal terminals and the adjacent ground terminals), however, it is possible to provide solutions where the % coupling on the signal pair is increased by at least 10% compared to the symmetric case so as to reduce the energy carried via the ground structure, which tends to reduce potential resonant energy on the ground terminals. The reduction in energy on the ground terminals reduces amount of energy that is reflected and thus helps reduce crosstalk. As can be appreciated, further benefits can be obtained if a 20% increase in % coupling is obtained and even more benefits can be obtained if a 30% increase in % coupling is obtained. While the amount of increase in % coupling that is sufficient to ensure low crosstalk (e.g., less than 40 dB) due to energy reflections on the ground terminal will vary, it is expected that increasing the % coupling by about 30% will typically be sufficient.

Figure 5:
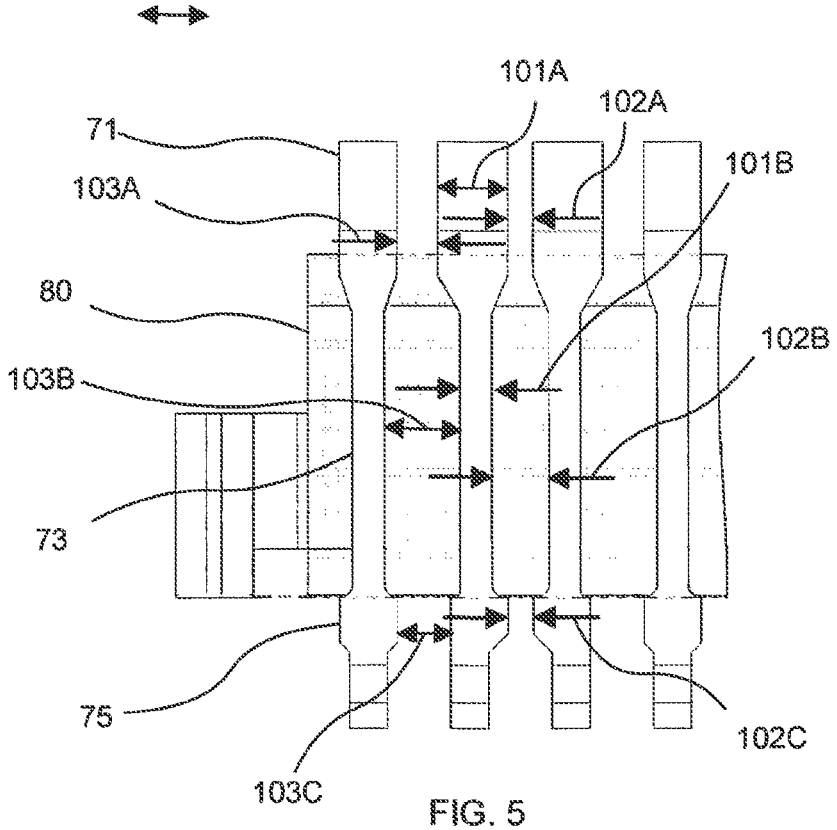
FIG. 5 illustrates a partial elevated rear view of an embodiment of a set of terminals supported by a terminal block.
Figure 6:
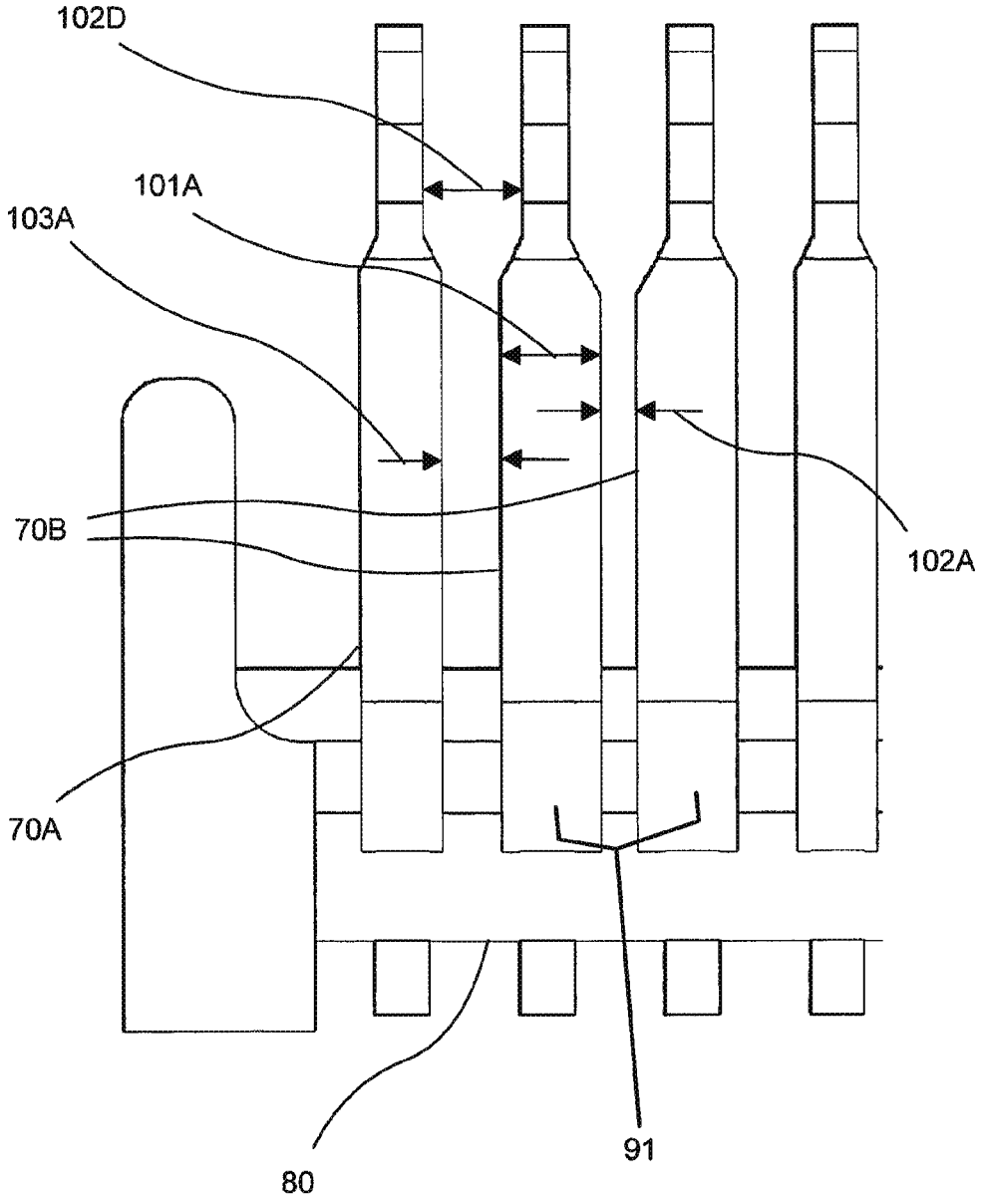
FIG. 6 illustrates a partial elevated top view of an embodiment of a terminal block and terminals.
Figure 7:
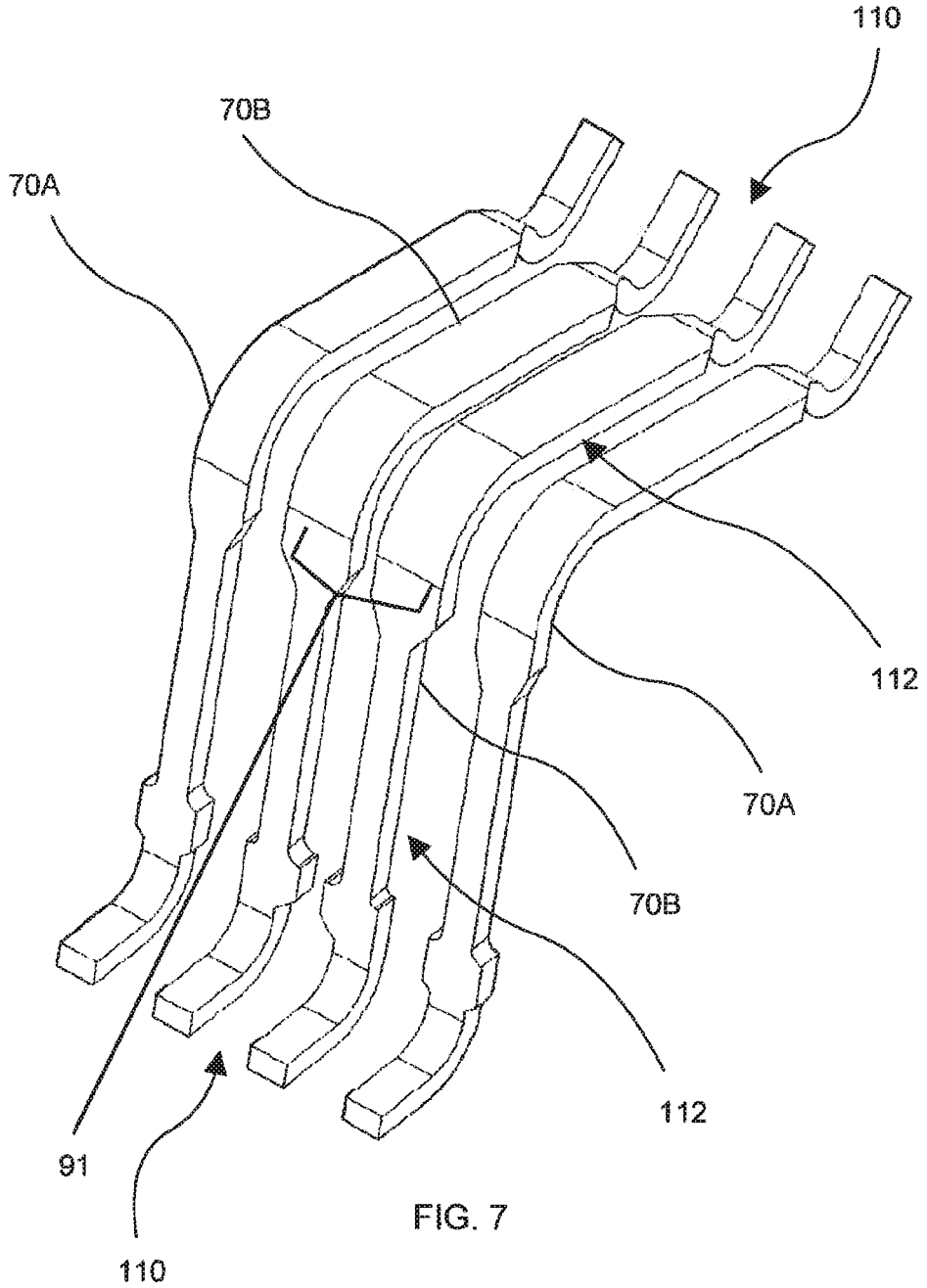
FIG. 7 illustrates a perspective view of an embodiment of terminals that can be supported by a terminal block.

As can be appreciated, further increases in % coupling versus the symmetric case can provide further benefit. For example, in an embodiment such as is depicted in FIG. 5, distance 103A could be 0.325 mm and the distance 102A could be 0.2 mm. With the above noted assumptions on terminal design, this would result in a calculated value of 0.448 or 44.8% energy carried via differential coupling. A sample with a design as shown in FIGS. 1A-7 that included distances of 0.325 and distances 0.2 was tested. The common mode impedance was tested as being 65 ohms and the differential impedance was 100 ohms. Using the formula % coupling=(Zeven−Zodd)/(Zeven+Zodd), where Zodd=Zdiff/2 and Zeven=2*Zcomm, the % coupling=(2*Zcom)−(Zdiff/2)/[2*Zcom+Zdiff/2]=(130−50)/(130+50)=80/180=44.4%. Thus, the experimental results map well with the theoretical results.

As there is generally a desire to provide a consistent impedance through the terminal, there are limits on how large of a percentage increase in % coupling is feasible. The terminal design illustrated in FIGS. 1A-7, for example, while providing a consistent 0.8 mm pitch at the contact, has about a 35% increase in % coupling as it goes from the standard 33% coupling to 44.8 percent coupling (or 44.4% coupling if the test data is used). Further increases over the standard 33% coupling might require changes in terminal geometry that would cause the differential impedance to vary away from an intended value.

In any event, it is beneficial to vary the ratio of the distance between the signal terminals that make up the differential pair and the distance between adjacent ground and signal terminals such that the % coupling is at least 36.5% (the 10% increase in coupling over the standard 33% coupling) and more beneficially is at least 39.6% (the 20 percent increase in coupling over the standard 33% coupling). Further benefits can be obtained by having at least a 30% increase in coupling (to about 43% coupling).

Because of the change in dielectric material, the terminals have a varied pitch and material thickness so as to reduce changes in impedance. The distance 102B is 0.45 mm and the distance 103B is 0.60 mm, which results in a % coupling of 40%. Thus, there is at least a 20% increase over the standard 33% coupling through the terminal body. It should be noted, therefore, while there are benefits to keeping the increase in % coupling consistent, in practice significant performance improvements can be obtained even if the increase in % coupling varies along the terminal. It should be further noted that as depicted, the distance the terminal is in the terminal block is about 2.7 mm and the total length of the terminal is slightly greater than 8 mm, thus terminal block occupies about a third of the total terminal length and based on a weighted average, the increase in % coupling is 0.33(7/33)+0.66(11.8/33), which equal about an average of about a 30.6 percent increase in % coupling. Generally speaking, using the weighted average allows the length of the terminal as well as other variations to be accounted for and is often beneficial.

Figure 8:
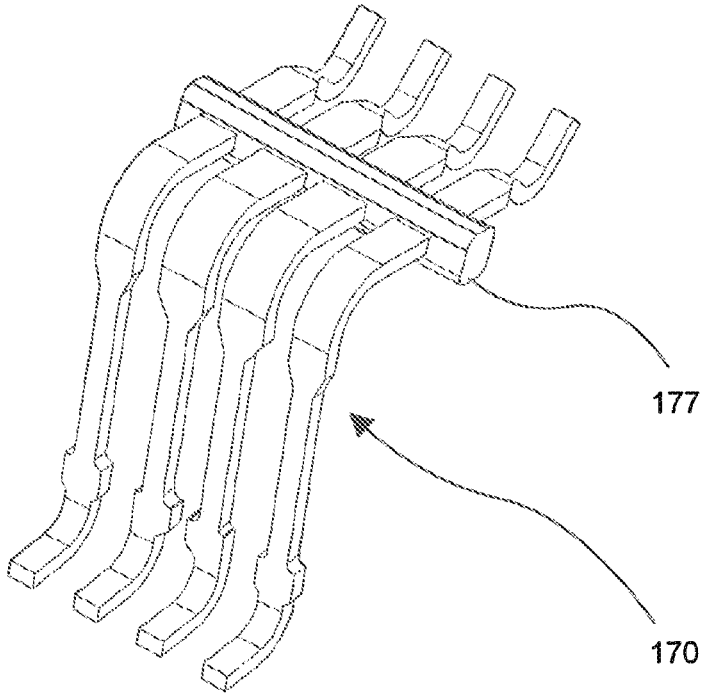
FIG. 8 illustrate a perspective view of an alternative embodiment of terminals that can be supported by a terminal block and an alignment block.
Figure 9:
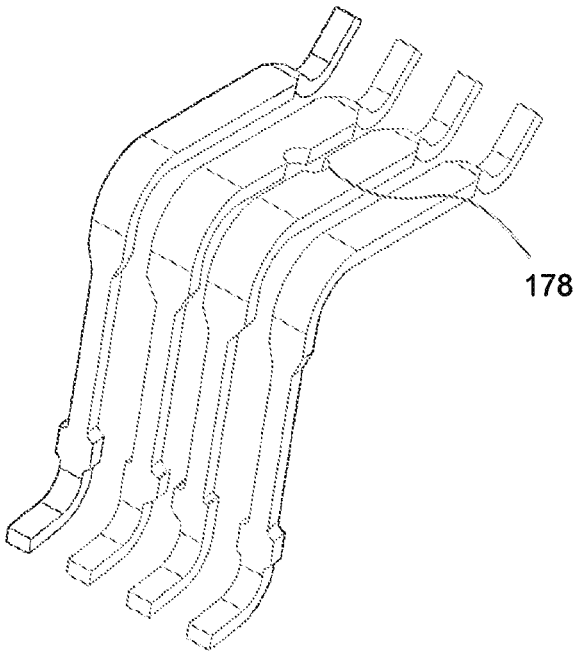
FIG. 9 illustrates a perspective view of the terminals depicted in FIG. 8 without the alignment block.
Figure 10:
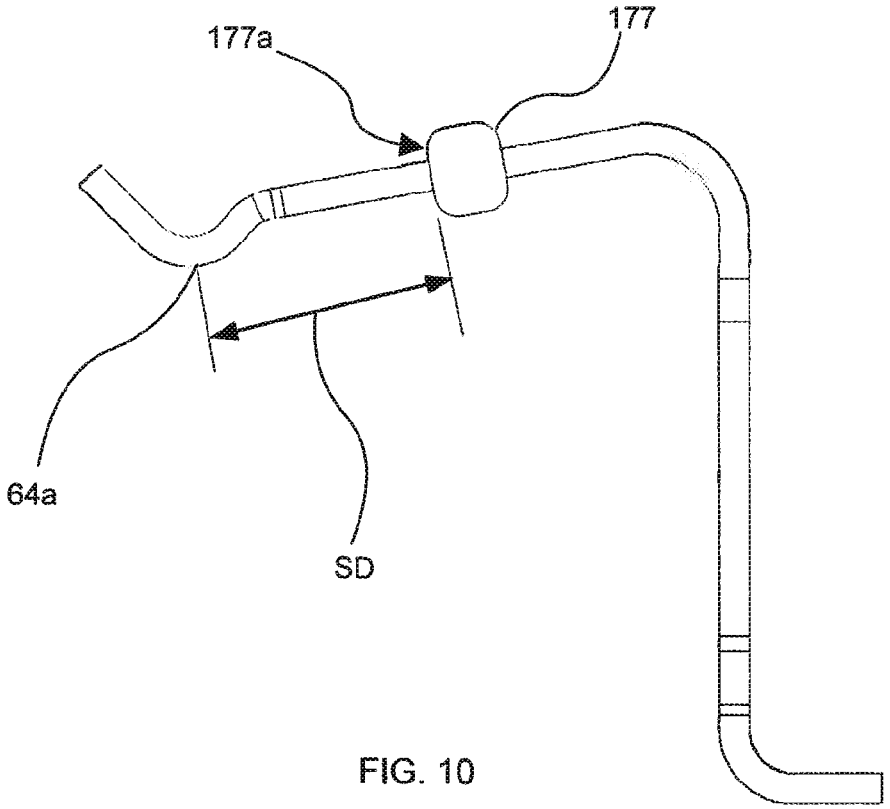
FIG. 10 is an elevated side view of an embodiment of a set of terminals that include an alignment block.
Figure 11:
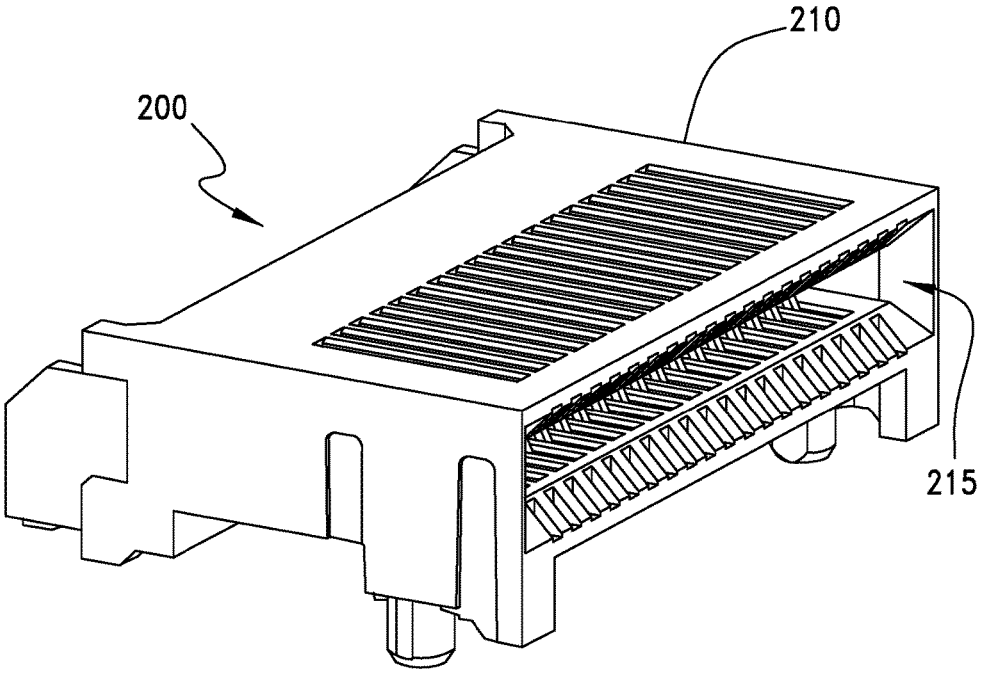
FIG. 11 illustrates a perspective view of an embodiment of a connector.
Figure 12:
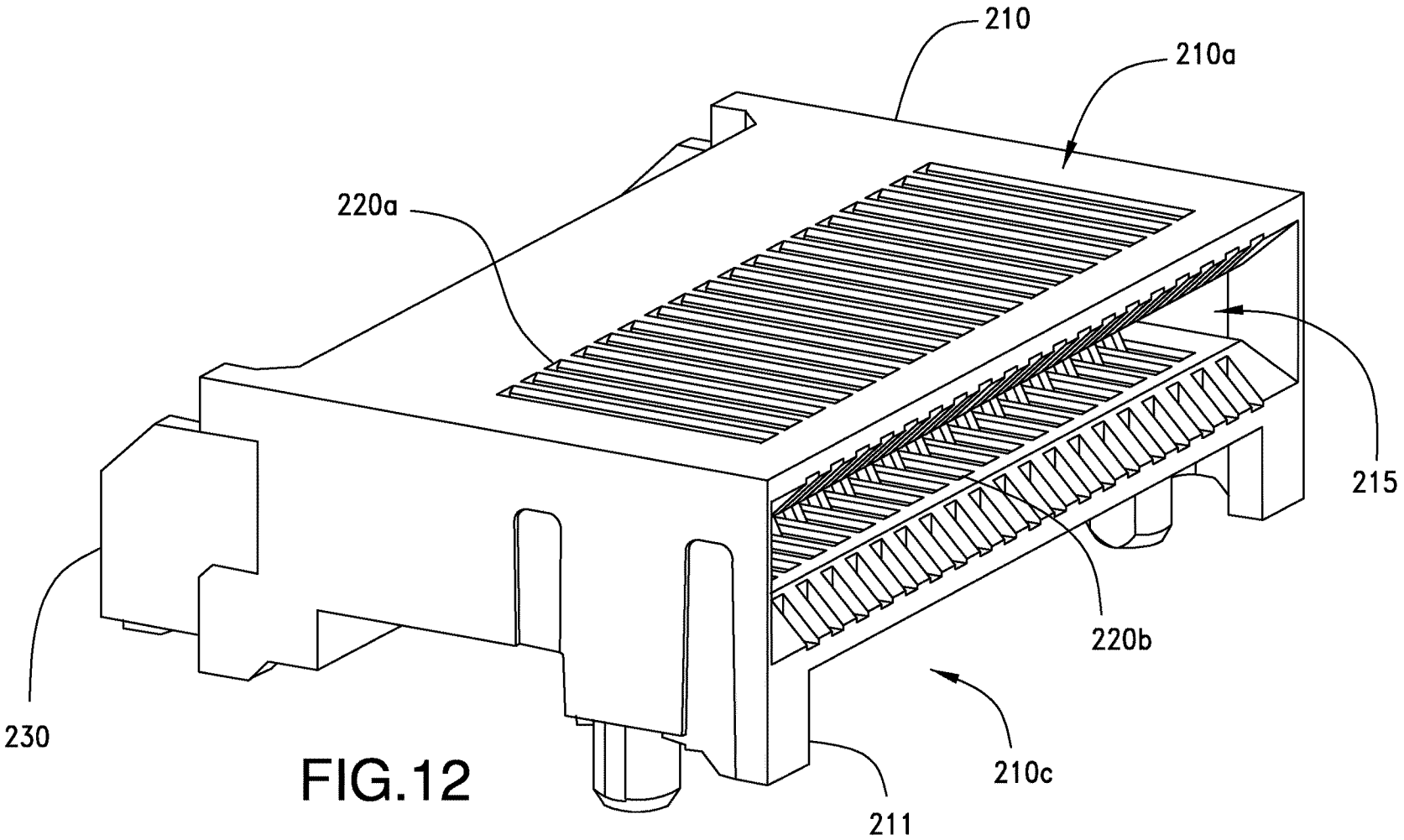
FIG. 12 illustrates an enlarged perspective view the connector depicted in FIG. 11.
Figure 13:
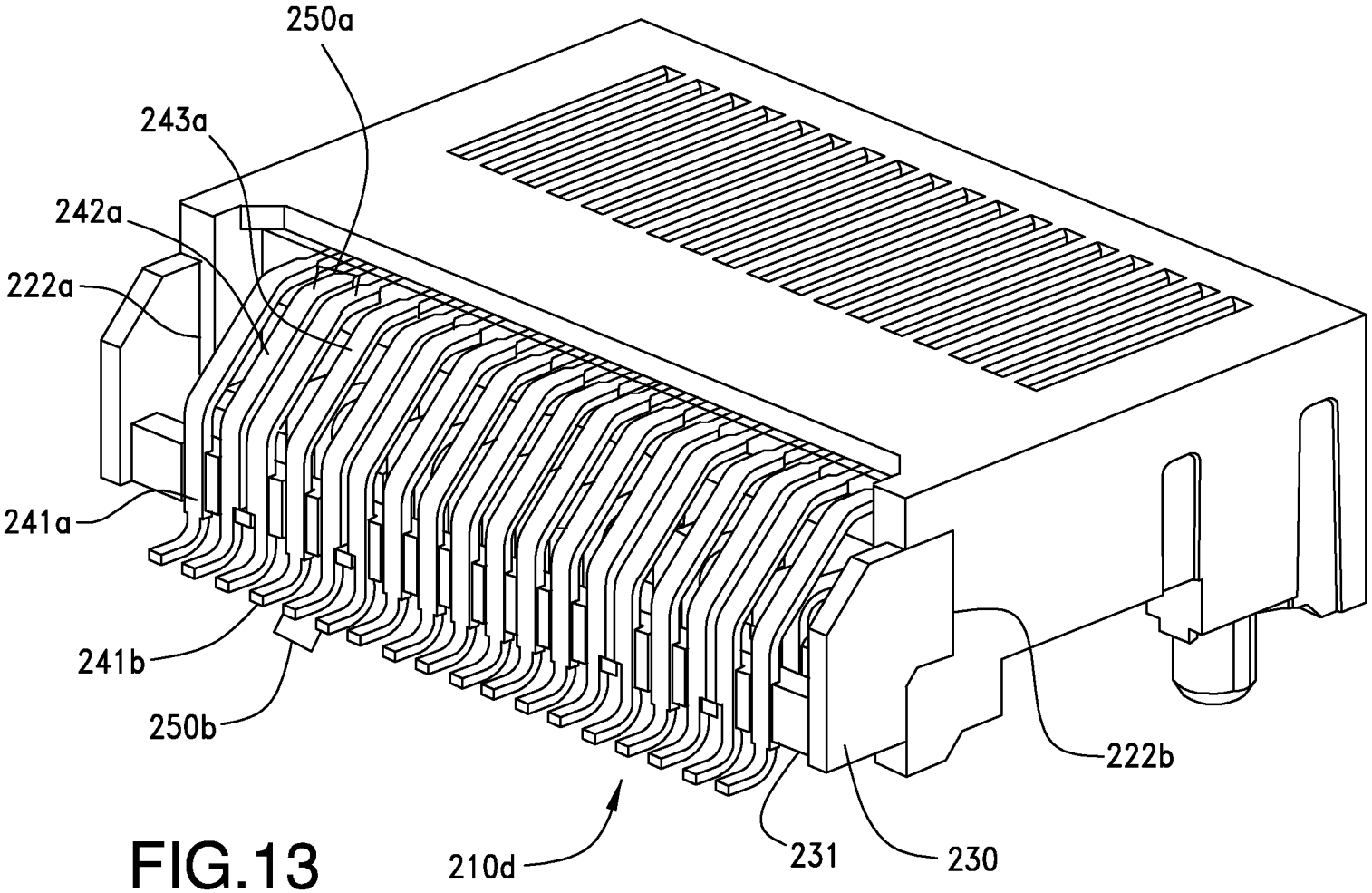
FIG. 13 illustrates another perspective view of the connector depicted in FIG. 11.
Figure 14:
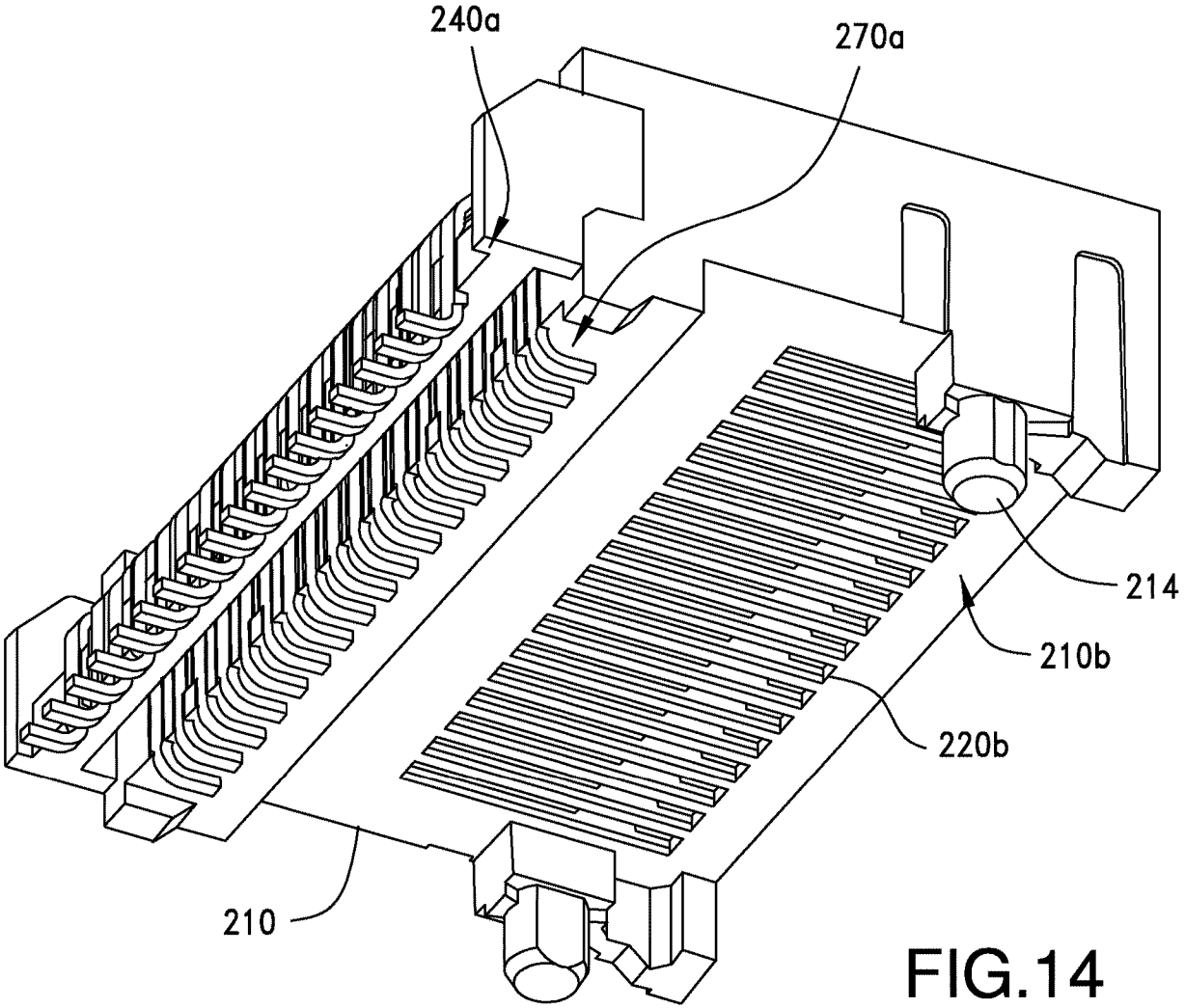
FIG. 14 illustrates another perspective view of the connector depicted in FIG. 11.
Figure 15:
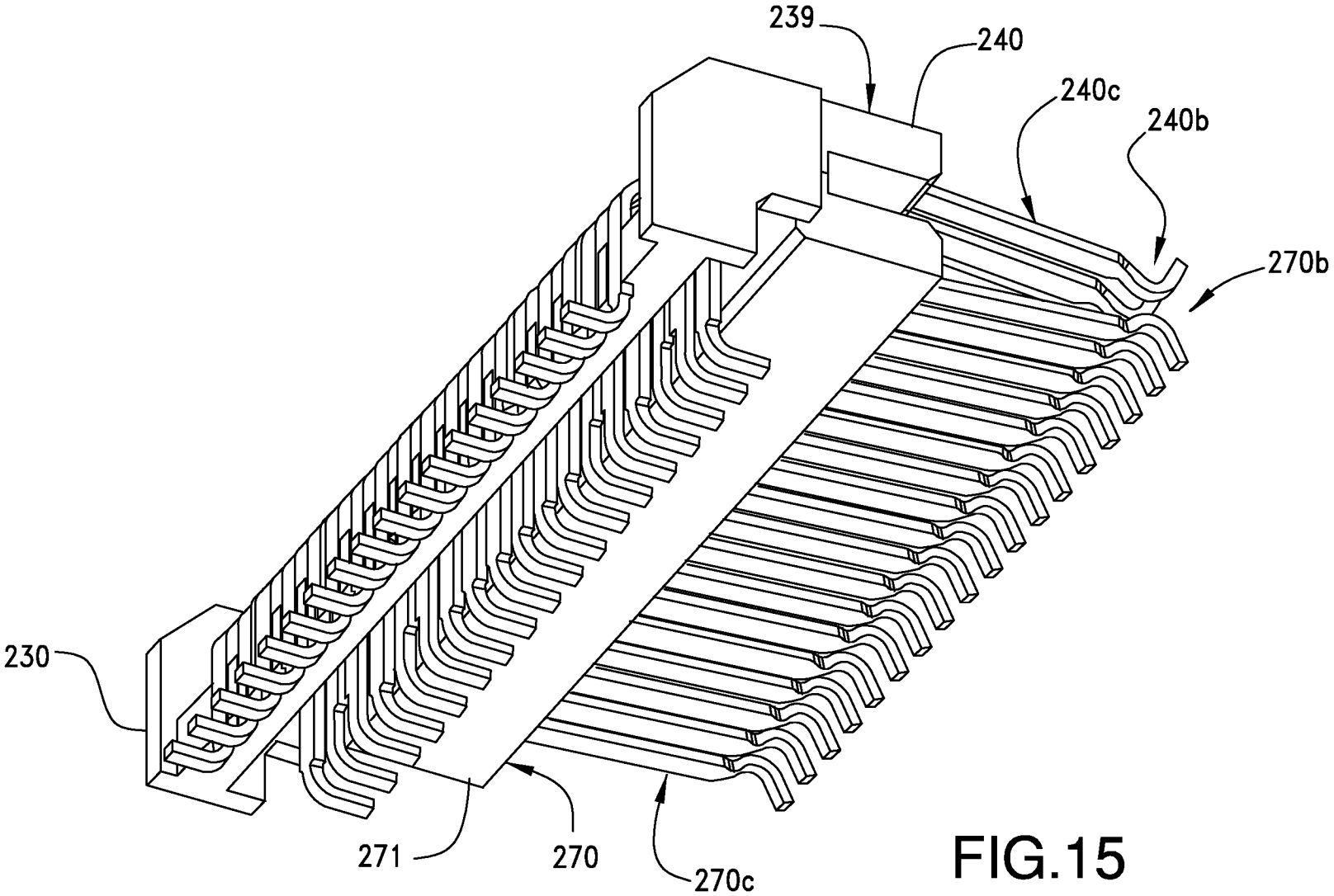
FIG. 15 illustrates a perspective view of an embodiment of two terminal sets suitable for use in the connector depicted in FIG. 11.
Figure 16:
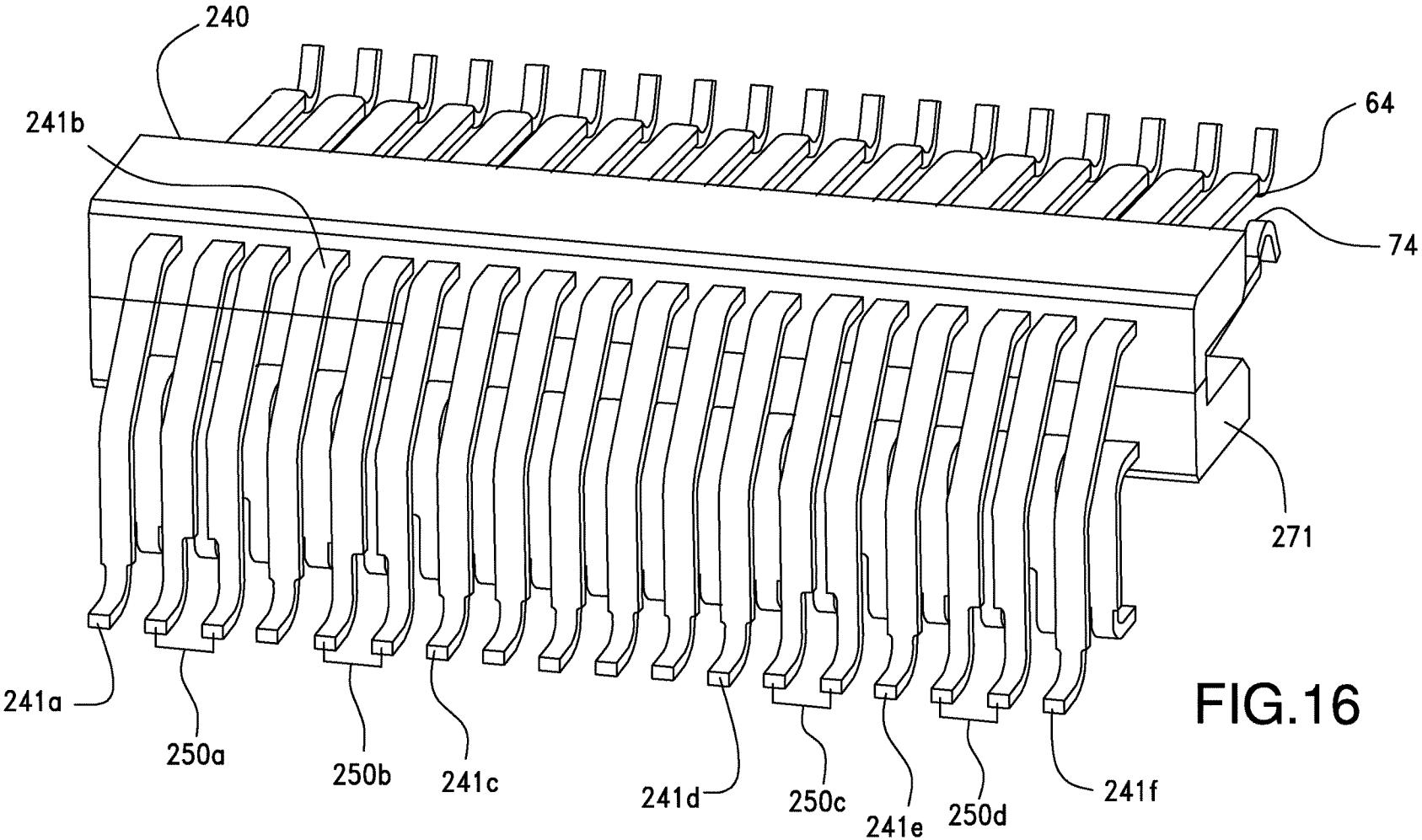
FIG. 16 illustrates a perspective simplified view of an embodiment of two terminal sets suitable for use in the connector depicted in FIG. 11.
Figure 17:
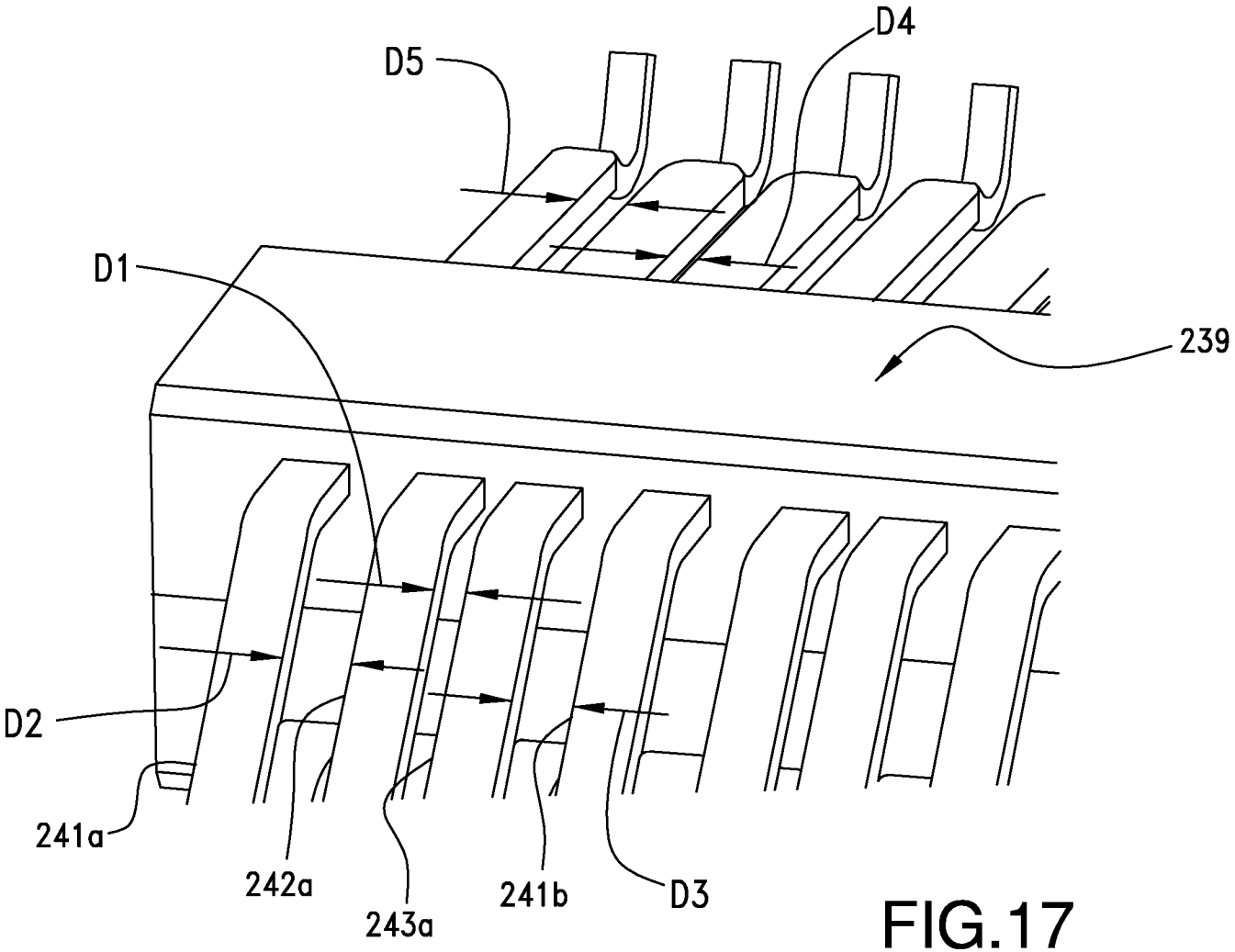
FIG. 17 illustrates an enlarged perspective view of terminals in a first terminal set.
Figure 18:
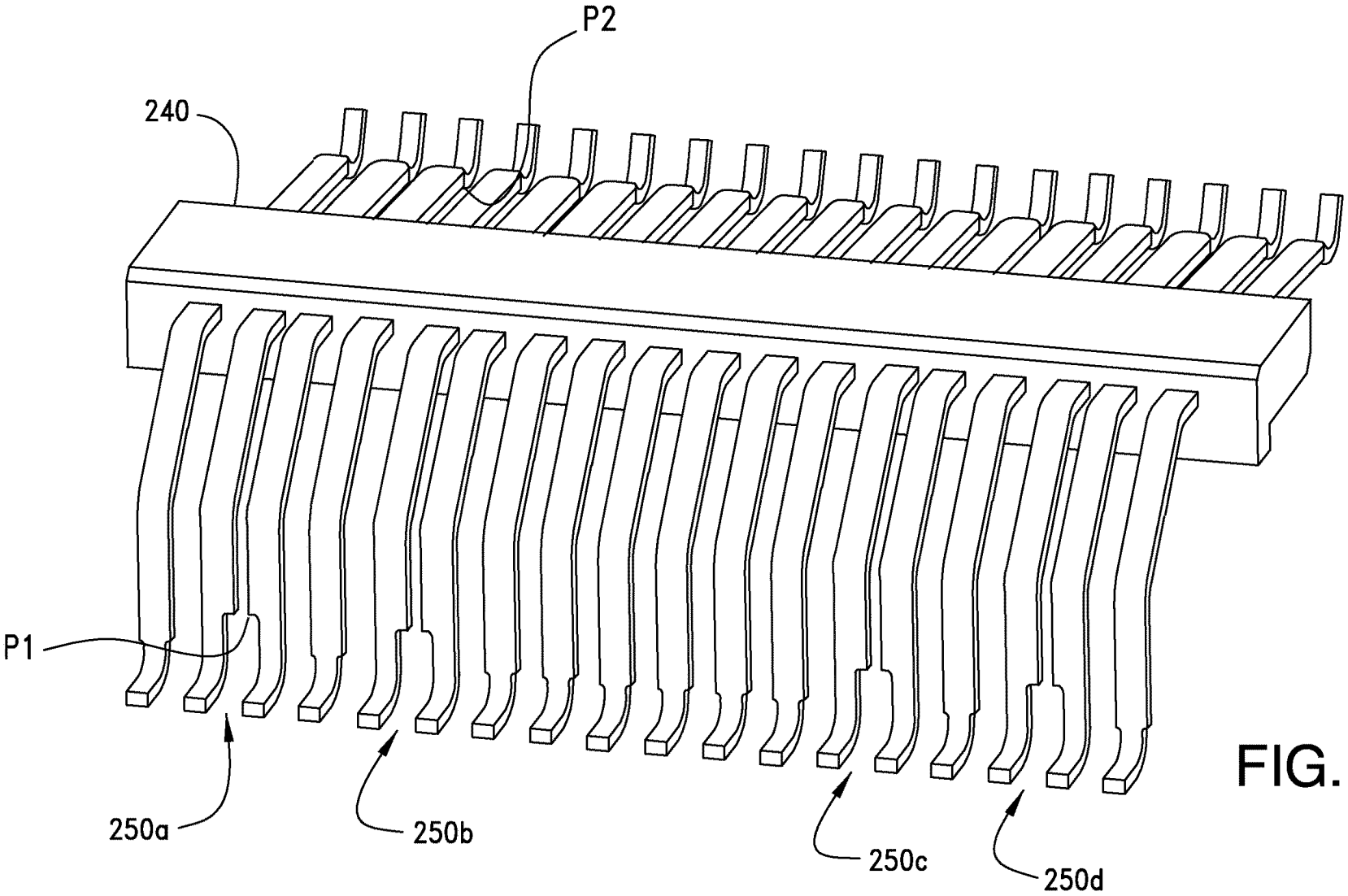
FIG. 18 illustrates a perspective simplified view of an embodiment of a first terminal set.
Figure 19:
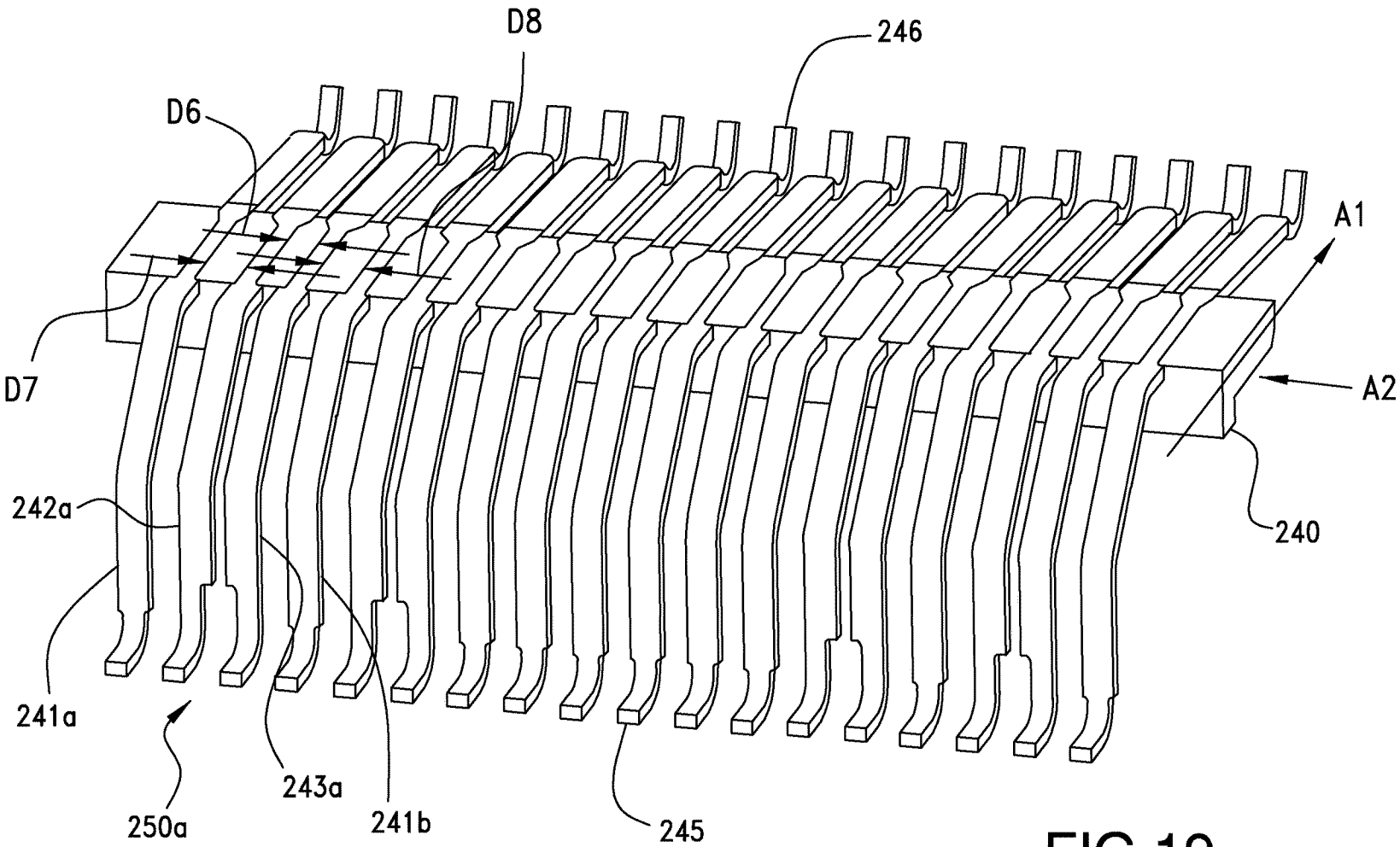
FIG. 19 illustrates a perspective cross-sectional view of the embodiment depicted in FIG. 18.
Figure 20:
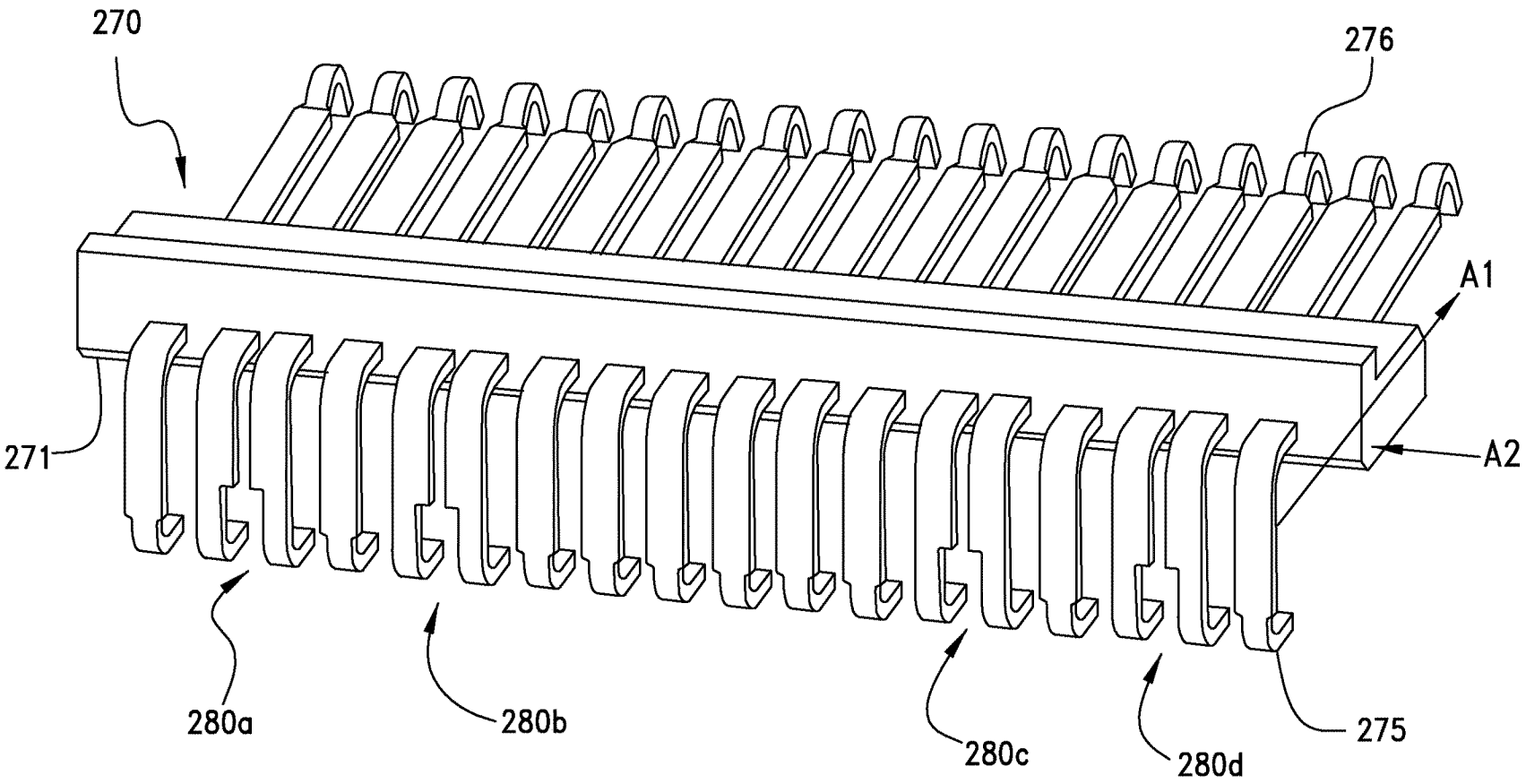
FIG. 20 illustrates a perspective view of an embodiment of a second terminal set.
Figure 21:
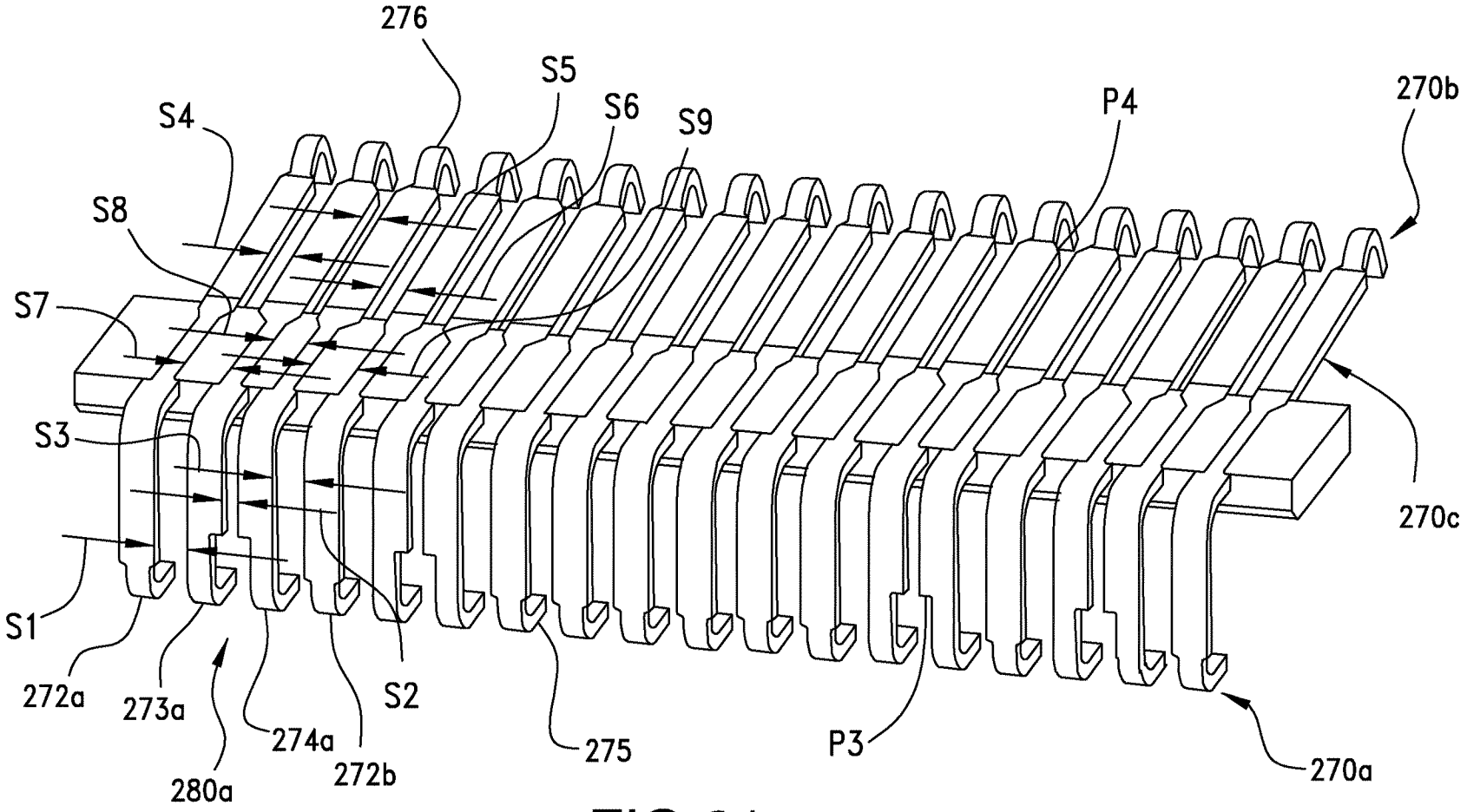
FIG. 21 illustrates a perspective cross-sectional view of the embodiment depicted in FIG. 20.
Figure 22:
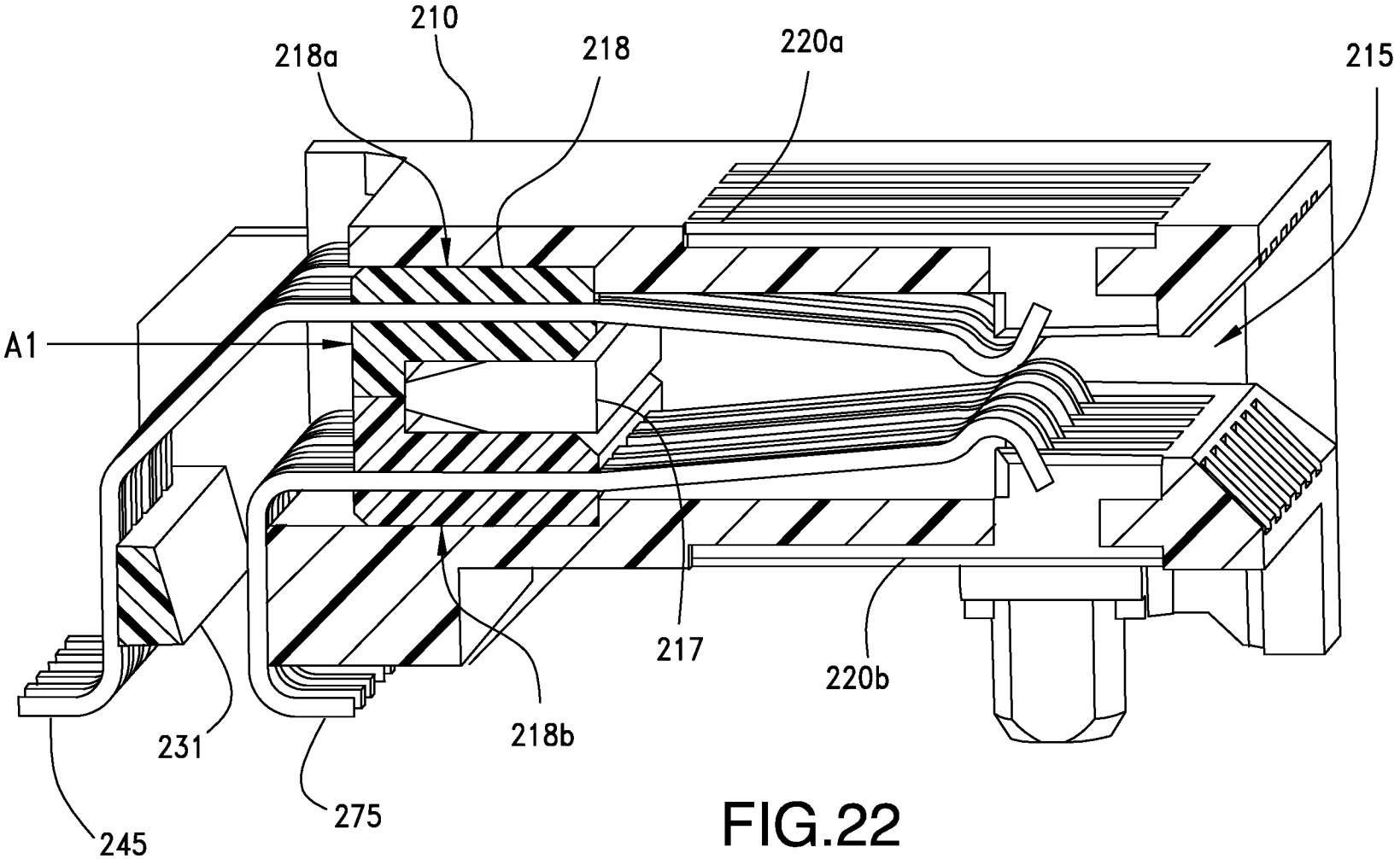
FIG. 22 illustrates a perspective cross-section view of the connector depicted in FIG. 11.
Figure 23:
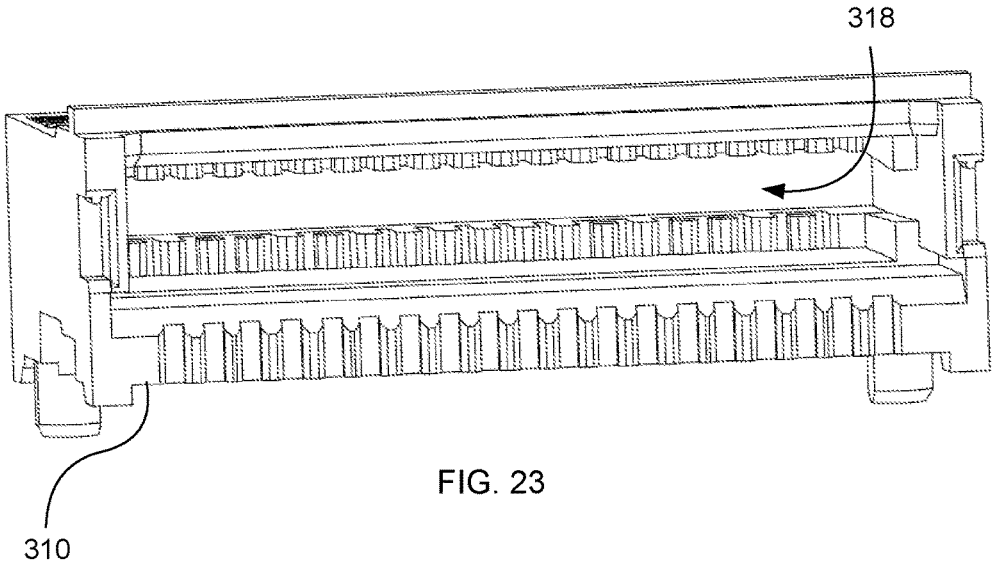
FIG. 23 illustrates a perspective view of another embodiment of a connector housing.
Figure 24:
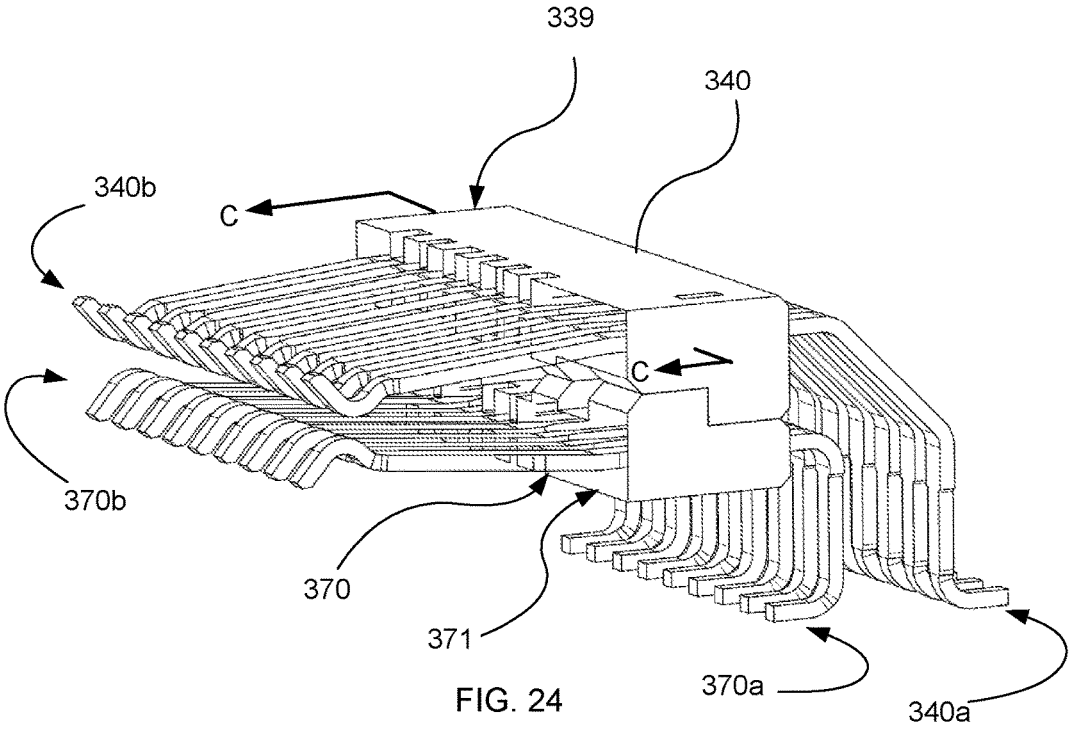
FIG. 24 illustrates a perspective view of an embodiment of two interlocked terminal sets.
Figure 25:
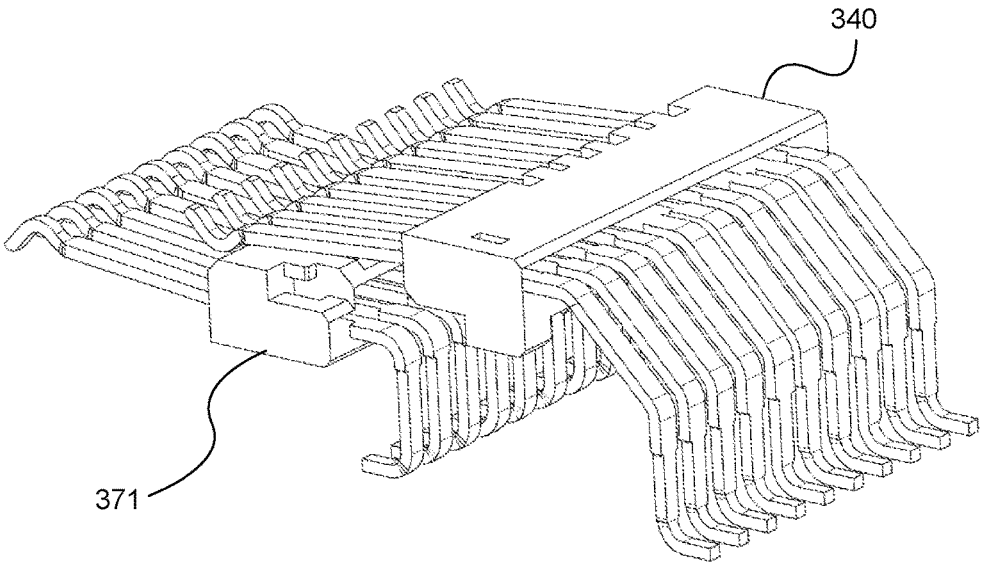
FIG. 25 illustrates a perspective exploded view of the terminal sets depicted in FIG. 24.
Figure 26:
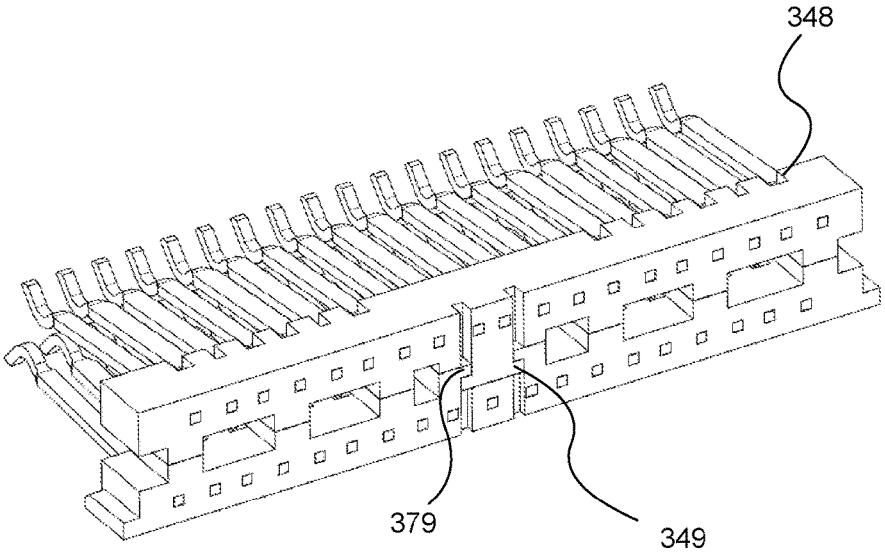
FIG. 26 illustrates a perspective view of a cross-section taken along line C-C of the interlocked terminal set depicted in FIG. 24.

FIGS. 8-10 illustrate features of an optional alignment block 177 and, as can be appreciated, the terminal block has been omitted for purposes of showing other features. As illustrated and discussed above, the terminals can be supported by the terminal block and the contact can extend in a cantilevered fashion from the terminal block. While this design is effective, it tends to require a refined manufacturing process with good quality control. To further improve reliability, an alignment block 177 can be included (such as is depicted in FIG. 8). The alignment block 177 helps ensure pitch between the contacts is controlled. If the alignment block 177 is not restrained by the corresponding connector housing, the terminals can still flex from the terminal block. As can be further appreciated, if there is a desire to have a first make, last break feature, such a feature can be provided on the contact pads of the mating circuit card. However, the terminals coupled by the alignment bar will tend to deflect together as a group. It should be noted that the alignment block 177 is only shown spanning across a single differential pair and such a design may be preferable (e.g., multiple alignment blocks may be provided). However, if desired, the alignment bar can extend transversely to some other number of differential pairs and can even extend across all the terminals supported by the terminal block. As can be appreciated, extending across all the terminals helps provide further support for each individual terminal in a transverse direction.

The alignment bar 177 can be positioned near the contacts 74 and in an embodiment a front face 177*a* of the alignment bar 177 is positioned so that distance SD between the front face 177*a* and a center point 64*a* of the contact 64 is less than 20 mm. In another embodiment, the front face 177*a* can be positioned so that SD is less than 10 mm. If the distance SD is reduced, the alignment bar 177 can provide greater transverse support at the contact. To help ensure the alignment bar is retained in the desired position on the terminals, alignment notches 178 can be provided in the terminals. The alignment notch may also be beneficial in maintaining consistent impedance through the differential pair. However, if the alignment bar is small then the alignment notch it is expected to have only a minor impact on the impedance and can be omitted if it is not determined to be beneficial in maintaining the position of the alignment bar 178.

Another embodiment of a connector 200 is depicted in FIGS. 11-22. The connector 200 includes a housing 210 with a top side 210*a*, a support side 210*b*, a mating face 210*c* and a support face 210*d*. A slot 215 is provided in the mating face 210*c* and terminal grooves 220*a*, 220*b* are provided on opposing sides of the slot 215. As can be appreciated, the terminal grooves can extend from the slot to the corresponding side of the connector. While not required, such a configuration allows the dielectric value experienced by the terminals to be reduced.

Similarly to configuration of the connector 10, the terminals are arranged in rows. As depicted, the terminals in the lower side of the slot 215 have a row of tails 270*a*, a row of contacts 270*b* and a row of bodies 270*c* while the terminals in the upper side of the slot 215 have a row of bodies 240*c*, a row of contacts 240*b* and a row of tails 240*a*. The terminals are thus arranged in a first terminal set 239 and a second terminal set 270. The first terminal set 239 supports the terminals with a block 240 that is insert-molded onto the corresponding terminals. Similarly, the second terminal set 270 has a block 271 that is insert-molded onto the terminals.

The blocks 240, 271 can be inserted into a channel 218 on the support face 210*d* and, as depicted, can be supported by cross-brace 217. Thus, the surface 218*a* and the cross-brace 217 support the block 240 and the surface 218*b* and the cross-brace 217 support the block 271. It should be noted that in an alternative embodiment, the block 240 and the block 271 could be configured so that they engage and support each other (thus removing the need for the cross-brace) and the cross-brace could be omitted. Thus, a number of possible variations exist for structures that could be used to support the terminal sets.

The depicted terminals of the first terminal set 239 are arranged so that there is a first signal pair 250*a* (which includes signal terminals 242*a* and 243*a*), a second signal pair 250*b*, a third signal pair 250*c* and a fourth signal pair 250*d*. As can be appreciated, ground terminals 241*a*-241*f* are positioned so that each signal pair is surrounded on two sides by a ground terminal. As noted above, in a convention connector such a configuration would tend to cause the differential coupling to carry about 33% of the energy. However, with the depicted arrangement (more of which will be discussed below) the differential coupling can carry more than 40% of the energy, as was discussed above.

As shown, the signal pair 250*a* has terminals 242*a* and 243*a* that are separated by a distance D1 between the tails 240*a* and the block 240, are separated distance D6 in the block and are separated by a distance D4 between the block and the contacts 240*b*. In an embodiment, distance D2 and D3 are the same and D7 and D8 are also the same. Thus, each signal terminal is separated from an adjacent ground terminal by a distance D2 between the tail 240*a* and the block 240, by a distance D7 in the block 240, and by a distance D5 between the block 240 and the contact 240*b*. Thus, as depicted, the distance between the terminals in a signal pair (D1, D6 and D4 going from the tail to the contact) is less than the distance between a signal and adjacent ground (D2, D7 and D5 going from the tail to the contact). Or to put it another way, the pitch between the bodies of the terminal in a signal pair is less than the pitch between the bodies of an adjacent signal and ground terminal. However, the pitch between the tails and the contacts is substantially constant along the row of tails 240*a* and contacts 240*c*. Thus, tail mating interface 245 and contact mating interface 246 for each terminal in the first terminal set 239 can be on the same pitch. As signal terminals in the first set shift to a closer arrangement between point P1 and P2, which allows a substantial portion of the signal terminals to be preferentially coupled (thus providing the desired increase in amount of energy being carried on the signal terminals, as well as the reduction in crosstalk).

The second terminal set 270 also is depicted with four signal pairs 280*a*-280*d* and each signal pair is surrounded on two sides by a ground terminal, as discussed with respect to the first terminal set 239. For example, tail interface 275 and contact interface 276 are provided on a constant pitch while the bodies of the signal pairs are at a lesser pitch compared to a body of the terminals of the signal pair and the adjacent ground terminal. Thus, distance S2 is less than distance S1 and S3 (which may be the same) and distance S5 is less than distance S4 and S6 (which may be the same) and distance S8 is less than distance S7 and S9 (which may be the same). Similarly to the terminals discussed above, the reduction in pitch takes place between point P3 and P4 (thus along a majority of the length of the terminal).

Thus, FIGS. 11-22 illustrate an embodiment that could be used as a 4× connector (3.g., 4 high data rate transmit channels and 4 high data rate receive channels). Such a connector, for example, would be suitable to provide a 25 Gbps data rate. As with the embodiment depicted in FIGS. 1A-7, the signal pairs are positioned closer together so as to increase the % of differential coupling.

In the embodiment depicted, the first terminal set 239 is also supported by a tail frame 230 that includes a cross-bar 231. The tail frame 230 helps control alignment of the terminal tails prior to mounting the terminals on a circuit board. The tail frame 230 can be inserted into notches 222*a*, 222*b* so that the tail frame 230 is securely supported by the housing 210.

FIGS. 23-26 illustrate another embodiment of a connector construction. As can be appreciated, a housing 310 includes a channel 318 but the channel 318 omits a cross-bar. Instead, terminals sets 339, 370 are configured to be inserted into the channel and to help support each other. In an embodiment, the self-support can be accomplished by having housings 340, 371 of the terminal sets 339, 370 coupled together. The coupling of the housings 340, 371 can be accomplished in any desirable manner and as depicted, may be accomplished by having the terminal sets interlocked such that a flange 349 engages shoulder 379 (which form a locking slot). Thus, the housings can engage each other and then be inserted into the channel so combination of the housings and the channel support the terminals.

As can be appreciated, the housing 340 can include a combed edge 348. While not required, it has been determined that the combed edge 348 allows for a more gradual transition between the block portion and the free portion and thus can help further improve electrical performance. It should also be noted that while contact rows 340*b*, 370*b* are similar to above embodiments, rows of tails 340*a*, 370*a* are slightly different, specifically the tail portion of each terminal is substantially the same as an adjacent terminals. This optional configuration may be helpful in tuning an electrical response of the terminals.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector comprising:

a housing with a mating face and a mounting side, the mounting side configured to be supported, in operation, by a circuit board, wherein a slot is positioned in the mating face, the slot having a first side with a first set of terminal grooves and a second side with a second set of terminal grooves; and a first terminal set positioned in the housing, the first terminal set supported by a first block that is inserted into the housing, the first terminal set forming a first row of terminals in the first side of the slot, each of the terminals in the first terminal set having a contact and a body portion that extends to the contact, the first row of terminals including a differential signal pair surrounded on both sides by a ground terminal, each of the terminals in the first row being configured such that the contacts in a first row are at a constant pitch and the body portions of the four terminals are substantially wider than the contacts such that the space between the body portions of the four terminals is less than the space between the contacts; and a second terminal set positioned in the housing, the second terminal set supported by a second block that is inserted into the housing, the second terminal set forming a second row of terminals in the second side of the slot, each terminal of the second terminal set having a contact and a body portion that extends to the contact, the second row of terminals including a differential signal pair surrounded on both sides by a ground terminal, each of the terminals in the second row being configured so that the contacts of the four terminals are at a constant pitch, the body portions of the four terminals in the second row being substantially wider than the contacts such that the space between the body portions of the four terminals in the second row is less than the space between the corresponding contacts, wherein the differential signal pairs are configured to support a 16 Gbps data rate.

2. The connector of claim 1, wherein the differential signal pairs are configured to support a 25 Gbps data rate.

3. The connector of claim 1, wherein a first distance between any adjacent two contacts of the four terminals is greater than a distance between any two adjacent body portions of the four terminals.

4. The connector of claim 1, wherein the body portions of the two signal terminals are closer together than the body portions of an adjacent signal and ground terminal.

5. The connector of claim 1, wherein the body portion extending to the contact is cantilevered such that the body portion adjacent to the contact is unsupported.

6. The connector of claim 5, wherein the unsupported body portion is not positioned in the terminal groove and at least a portion of the contact is positioned in the terminal groove.

7. The connector of claim 5, wherein the body portions extending toward the contact are substantially a constant width from a final point of support until the contact.

8. The connector of claim 1, wherein the contacts are uniformly spaced apart by more than 0.4 mm and the body portions are spaced apart by less than 0.4 mm.

9. The connector of claim 8, wherein body portions are configured so that the signal terminals are preferentially coupled, the signal terminals being configured to carry more than 35 percent of the energy.

10. The connector of claim 9, wherein the signal terminals are configured to carry more than 40 percent of the energy.

* * * * *